US007771185B2

(12) United States Patent
Hurst et al.

(10) Patent No.: US 7,771,185 B2
(45) **Date of Patent: *Aug. 10, 2010**

(54) CARPET STRAIGHTENING APPARATUS

(75) Inventors: Kevin W. Hurst, Dalton, GA (US); R. Shawn Marshall, Altus, OK (US); Gavin B. Rumble, Lexington, NC (US)

(73) Assignee: S & K Carpet Specialist, LLC, Dalton, GA (US)

( * ) Notice: Subject to any disclaimer, the term of this patent is extended or adjusted under 35 U.S.C. 154(b) by 207 days.

This patent is subject to a terminal disclaimer.

(21) Appl. No.: 11/899,390

(22) Filed: Sep. 4, 2007

(65) Prior Publication Data

US 2008/0313872 A1 Dec. 25, 2008

Related U.S. Application Data

(60) Continuation-in-part of application No. 10/884,546, filed on Jul. 1, 2004, now Pat. No. 7,513,770, and a division of application No. 10/112,983, filed on Mar. 29, 2002, now Pat. No. 6,800,235.

(51) Int. Cl.
*B29C 53/16* (2006.01)
*D06C 3/00* (2006.01)

(52) U.S. Cl. ..... 425/383; 26/51

(58) Field of Classification Search ..... 26/51, 26/51.3, 52; 425/383, DIG. 48
See application file for complete search history.

(56) References Cited

U.S. PATENT DOCUMENTS 1,207,692 A 12/1916 McNeill
2,434,111 A 1/1948 Hawley, Jr. et al.
2,627,923 A 2/1953 Duncan
2,745,134 A * 5/1956 Collins ..... 26/51
3,551,970 A 1/1971 Cohn, et al.
3,561,693 A 2/1971 Ulyate
3,643,885 A 2/1972 Keesling et al.
3,688,354 A * 9/1972 Cohn et al. ..... 26/52
3,696,475 A 10/1972 Fleissner
3,771,952 A 11/1973 Holm
3,867,826 A 2/1975 Noe
4,008,879 A 2/1977 Youngman
RE29,267 E 6/1977 Leitner et al.
4,041,818 A * 8/1977 Rummer ..... 83/256

(Continued)

FOREIGN PATENT DOCUMENTS

EP 0 472 393 8/1991

(Continued)

*Primary Examiner*—Yogendra N Gupta
*Assistant Examiner*—Emmanuel S Luk
(74) *Attorney, Agent, or Firm*—McAfee & Taft

(57) ABSTRACT

A straightening apparatus for straightening carpet prior to laying the carpet on a floor surface. The apparatus includes an entry conveyor from which carpet is unrolled and fed into a heating section. In the heating section, the carpet is heated sufficient to soften backing material on the carpet. The heated carpet is then fed into a heated straightening section where longitudinal forces are applied while the backing is still soft so that a pattern in the carpet is straightened and held in the straightened position until the carpet has cooled somewhat. The apparatus further includes a cooling section for cooling of the carpet, after which the carpet is rolled back up on an exit conveyor.

62 Claims, 24 Drawing Sheets

U.S. PATENT DOCUMENTS 4,084,787 A 4/1978 Kowalczyk
4,140,574 A 2/1979 Justus
4,261,498 A 4/1981 Short
4,545,544 A 10/1985 Rockerath et al.
5,067,755 A * 11/1991 James ..... 292/33
5,145,225 A 9/1992 Muller et al.
5,228,660 A 7/1993 Massicotte
5,355,564 A 10/1994 Gunter, Jr. et al.
5,472,170 A 12/1995 Anasson
5,836,205 A * 11/1998 Meyer ..... 74/89.17
5,843,492 A 12/1998 McCorry
6,170,727 B1 1/2001 Hevenor et al.
6,776,109 B2 8/2004 Segars et al.
6,888,635 B2 5/2005 Lacovara

FOREIGN PATENT DOCUMENTS

EP 0 529 460 8/1992

* cited by examiner

CARPET STRAIGHTENING APPARATUS

CROSS-REFERENCE TO RELATED APPLICATION

This application is a continuation-in-part of U.S. patent application Ser. No. 10/884,546 filed Jul. 1, 2004, now U.S. Pat. No. 7,513,770 a divisional of Ser. No. 10/112,983 filed Mar. 29, 2002, now U.S. Pat. No. 6,800,235 issued Oct. 5, 2004.

BACKGROUND OF THE INVENTION

1. Field of the Invention

This invention relates to apparatus and methods for straightening carpet, and more particularly, to an apparatus for straightening carpet after it has left the mill and is otherwise ready for installation.

2. Brief Description of the Prior Art

Carpet is produced at mills in large rolls as is well known. The length or longitudinal direction of the carpet in these rolls can be several times the width or transverse direction of the roll. As the carpet is produced at the mill, the woven or tufted material is notoriously not straight. That is, the weave can vary considerably along the length of the carpet. This is not a significant problem for plain carpet, but it can be very noticeable on carpet which has a pattern in it, particularly when that pattern has a transversely extending feature to it. For example, a carpet which nominally has a plurality of transversely extending parallel straight lines may actually look like it has wavy lines in it.

Historically, these problems with lack of straightness in carpet patterns have had to be fixed by the carpet installer. That is, when laying the carpet, the installer has had to pull longitudinally on the carpet at various places along its length to bring the pattern back into its proper relationship. Using the parallel line example again, the installer has to pull to stretch the carpet until the transverse lines actually appear straight. There are a number of tools designed to engage the surface of the carpet and allow for such stretching. Many of these devices are manually operated, although some have mechanical actuation such as by a hydraulic cylinder. All have disadvantages in that they must be moved to the installation site and relocated on the surface of the carpet at each point in the installation process at which the installer decides is necessary. This greatly increases installation time and cost for laying patterned carpet and can require considerable physical exertion by the installer.

Another problem is that, even with these straightening techniques, mill tolerances are sometimes so great that installers cannot get the carpet straight enough manually and noticeable variations remain.

There is a need, therefore, for an apparatus for straightening carpet at the installation site, or elsewhere, which reduces the time required in prior art installations and is not so physically demanding on installation personnel. The present invention solves this problem by providing an apparatus comprising a heating section wherein the backing on the carpet is softened enough that the carpet can be straightened even when the pattern varies so much that normal manual straightening techniques on carpet at ambient temperatures are not sufficient. As the carpet exits the heating section, it enters a hydraulically controlled straightening section which allows forces in a longitudinal direction to be applied at various locations across the width of the carpet. This powered stretching allows the operator to straighten the heated carpet regardless of the large tolerances in the pattern. After straightening, the apparatus has a cooling section in which the carpet is allowed to cool after being stretched so that the pattern remains straight. The carpet then exits the apparatus with the pattern straightened. The roll of carpet may then be installed much more quickly because the installer does not have to do as much to the carpet as it is laid on the floor.

SUMMARY OF THE INVENTION

The present invention includes an apparatus for straightening carpet so that the carpet is more easily laid down. The apparatus can be used at any location including where the carpet is to be installed.

The invention may be described as an apparatus for straightening carpet comprising a heating section for heating at least a portion of a roll of carpet such that a backing material on the carpet is softened, and a straightening section which is adapted for applying stretching forces to the heated carpet, whereby the carpet is straightened while the backing is softened and remains substantially straight after the backing is cooled.

The apparatus may further comprise an entry section adjacent to the heating section and adapted for receiving the roll of carpet thereon. The entry section preferably comprises an entry conveyor having an upwardly concave curvilinear configuration adjacent to an entry side of said heating section. The entry conveyor may define a recess adapted for receiving the roll of carpet. In one embodiment, the entry conveyor comprises a curvilinear support and a plurality of rollers disposed on the support.

The heating section comprises a duct, having an entry side and an exit side, and a heater disposed in the duct between the entry and exit sides. The heating section preferably further comprises a blower in communication with the duct for blowing air therethrough and across the heater.

In another embodiment, the heating section comprises an infrared oven.

In one embodiment, the duct comprises a lower duct and an upper duct in communication with said duct. The blower is in communication with the lower duct. The lower duct may be divided into a pair of sections, each having a blower in communication therewith. In this embodiment, the heater is preferably disposed within said lower duct. The heater may be characterized as one of a plurality of finned strip heaters.

The straightening section comprises a straightening table on which the carpet may be moved after exiting the heating section and a straightening array for engaging said carpet and applying said forces thereto. The straightening array comprises a plurality of straightening plates adapted for gripping engagement with the carpet and a corresponding plurality of cylinders pivotally connected to the straightening plates for actuating the straightening plates into and out of engagement with the carpet.

The straightening section has a duct with a blower in communication therewith for blowing air along an underside of the straightening table. Heaters are used to heat the air such that heat is transferred to the straightening table to keep heat applied to the carpet during the straightening operation.

The straightening section further comprises a clamping array for engaging and holding the carpet as the straightening array applies the stretching forces to the carpet. The clamping array comprises a plurality of clamping plates adapted for gripping engagement with the carpet and a corresponding plurality of cylinders connected to the clamping plates for actuating the clamping plates into and out of engagement with the carpet. In one embodiment, the clamping array is one of a plurality of clamping arrays.

The carpet straightening apparatus further comprises a cooling section on an opposite side of the straightening section from the heating section. The cooling section comprises a table on which the carpet lays substantially flat.

The straightening and clamping arrays are mounted on tracks so that they are movable along and between the straightening and cooling tables. The straightening and clamping arrays may be locked together with a locking bar so that the arrays are simultaneously movable.

The apparatus also comprises an exit section for receiving the carpet after it exits the straightening and cooling sections. The exit section preferably comprises an exit conveyor with an upwardly concave curvilinear configuration adjacent to the cooling section. The exit conveyor preferably defines a recess adapted for receiving the roll of carpet as it is moved away from said cooling section. In one embodiment, the exit conveyor comprises a curvilinear support and a plurality of rollers thereon disposed on said support.

The apparatus may further comprise a tenter system for engaging the carpet adjacent to a border thereof and substantially preventing transverse stretching of the carpet as the longitudinal stretching forces are applied thereto. In one embodiment, the tenter system comprises a bar and an arm pivotally disposed adjacent to the bar and having a plurality of teeth thereon. The arm has a first position pivoted away from the bar and a second position adjacent to the bar wherein the teeth on the arm engage the carpet so that it is held between the arm and bar. The bar may define a plurality of holes through which the teeth extend when engaging the carpet. A moveable bracket may be provided for moving the arm from the first position to the second position thereof. The bracket is preferably moved by actuation of a cylinder.

The bar and arm of the tenter system are preferably mounted to a carriage assembly that is longitudinally moveable along the frame of the apparatus.

In one embodiment, the apparatus comprises a pulling clamp assembly for engaging the carpet and moving it from the heating section to the cooling section. It may further comprise a holding clamp assembly spaced from the pulling clamp assembly and adapted for engaging the carpet and holding it in the straightened position as it is moved by the pulling clamp assembly.

The apparatus of the present invention may also comprise a corrective reference for indicating straightness of the carpet adjacent to the pulling clamp assembly.

In one embodiment, the straightening section comprises a plurality of working plates adapted for engagement with the carpet and a plurality of working cylinders corresponding to the working plates whereby the plates may be moved into and out of engagement with the carpet. All of the working cylinders can be pivoted with respect to the carpet substantially simultaneously. Preferably, the working cylinders are substantially parallel and are selectively actuable individually and in combination.

This embodiment may further comprise a primary clamp assembly spaced from the working plates and adapted for clamping the carpet whereby the carpet is held while the stretching forces are applied. The primary clamp assembly comprises a gripper and a gripper cylinder for moving the gripper into and out of engagement with the carpet.

The apparatus comprises a control system for controlling at least the heating, straightening and sections.

Numerous objects and advantages of the invention will become apparent as the following detailed description of the preferred embodiment is read in conjunction with the drawings illustrating such embodiment.

BRIEF DESCRIPTION OF THE DRAWINGS

FIG. 19 is a plan view of the second embodiment.

FIG. 26 is a perspective view of a pulling clamp assembly.

FIG. 28 shows a perspective view of a portion of a tenter system.

FIGS. 29A-29C show details of the tenter system.

FIG. 30 is a vertical cross section of the tenter system.

DESCRIPTION OF THE PREFERRED EMBODIMENTS

In the present application, two preferred embodiments of the carpet straightening apparatus of the present invention are shown and described below.

Description of the First Embodiment

Figure 1:
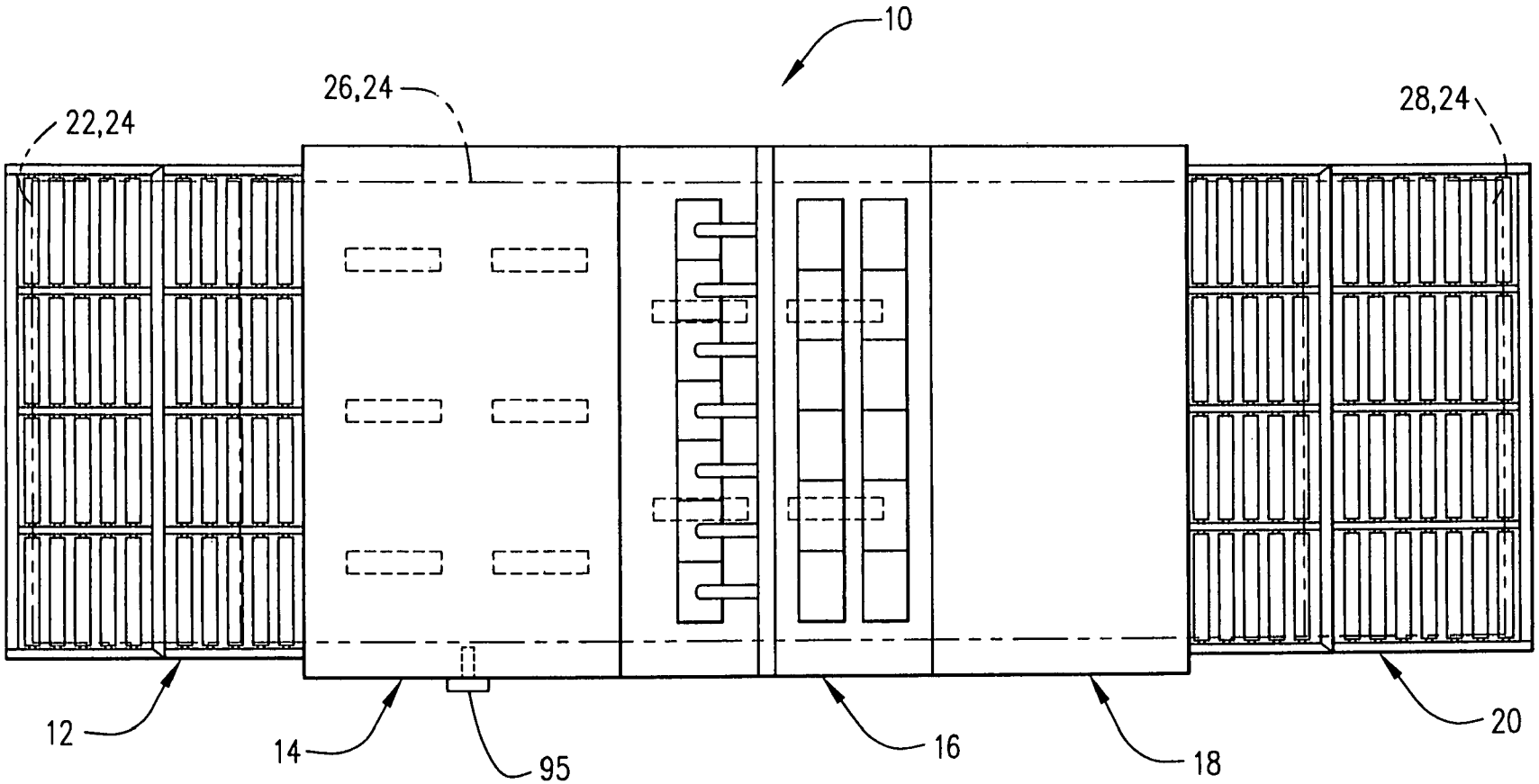
FIG. 1 is a schematic plan view of a first embodiment of the carpet straightening apparatus of the present invention.

Referring now to the drawings, and more particularly to FIG. 1, a first embodiment of the carpet straightening apparatus of the present invention is shown and generally designated by the numeral 10. The major components of first embodiment 10 are an entry conveyor 12, a heating section 14, a straightening section 16, a cooling section 18 and an exit conveyor 20. These major components are detachably connected so that they can be easily separated to facilitate the portability of first embodiment 10.

Entry conveyor 12 is adapted for receiving an entry roll 22 of carpet 24. Carpet 24 can be unrolled in place on entry conveyor 12 and extended as a flat length of carpet 26 along first embodiment 10. As will be further described herein, flat length of carpet 26 passes through heating section 14 and straightening section 16, over cooling section 18 and onto exit conveyor 20 on which the carpet is wound back into a roll 28 again which may be referred to as exit roll 28.

Figure 2A:
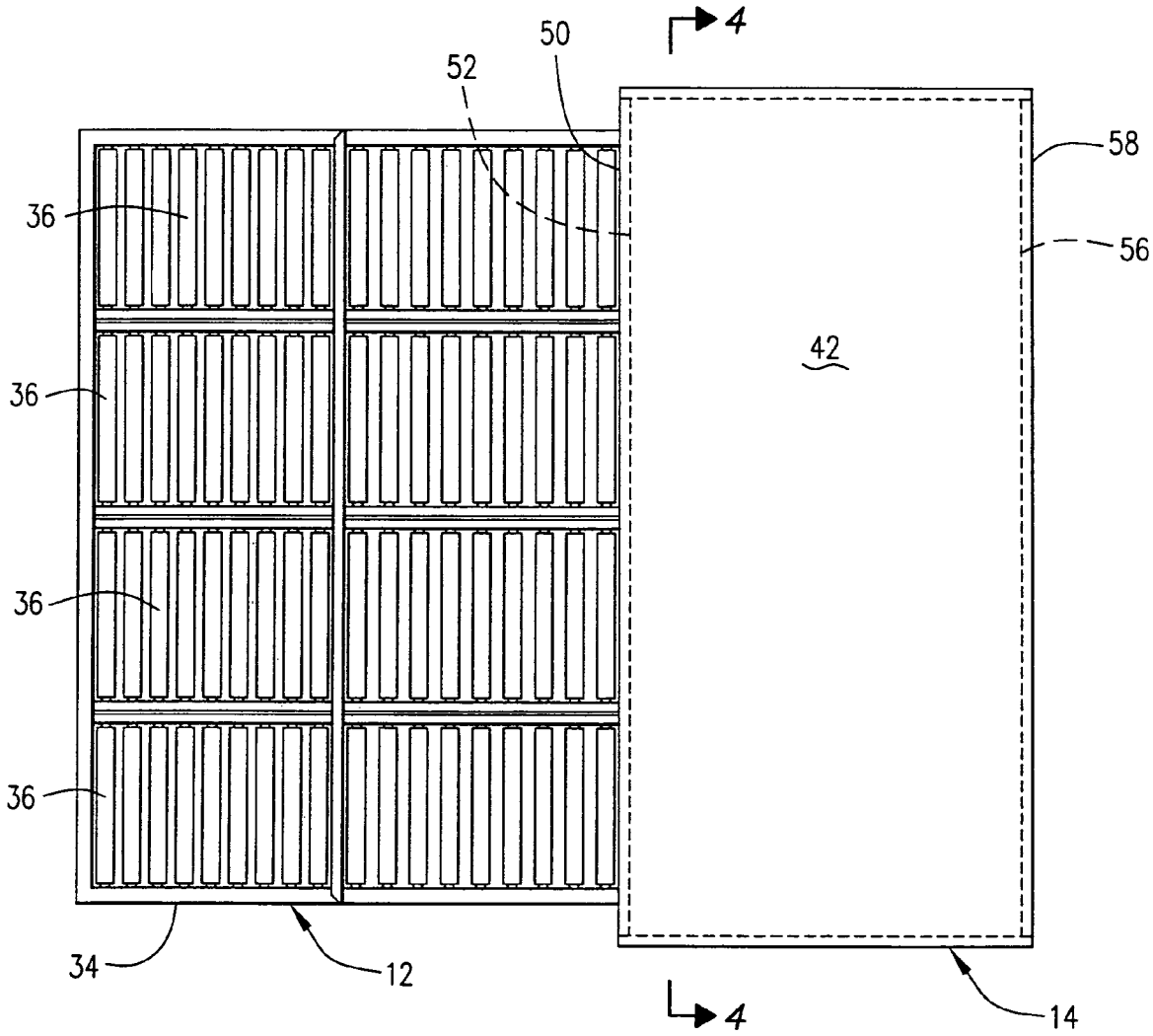
FIGS. 2A and 2B show a detailed plan view of the first embodiment.
Figure 3A:
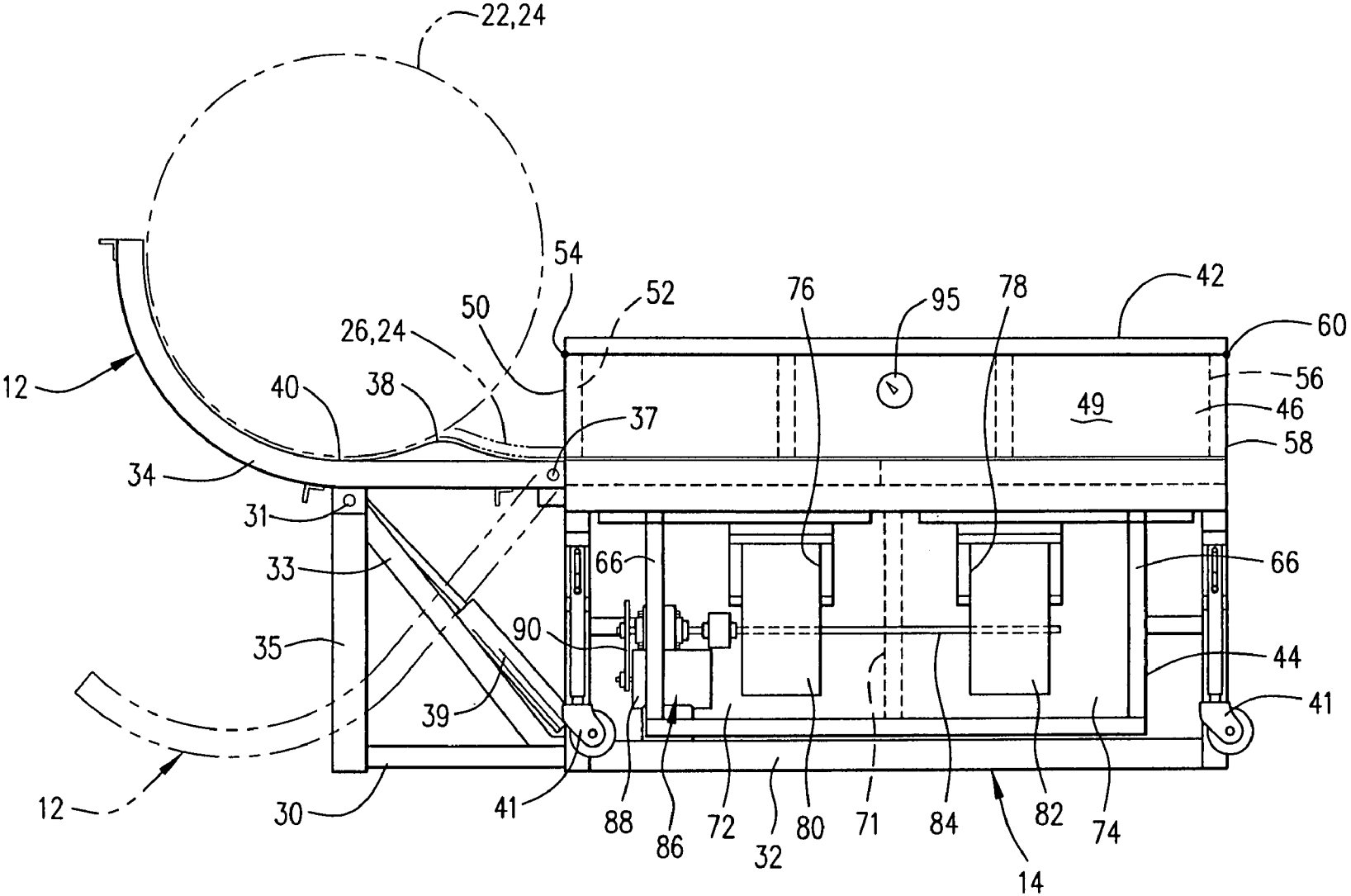
FIGS. 3A and 3B show a side view of the first embodiment.
Figure 3:
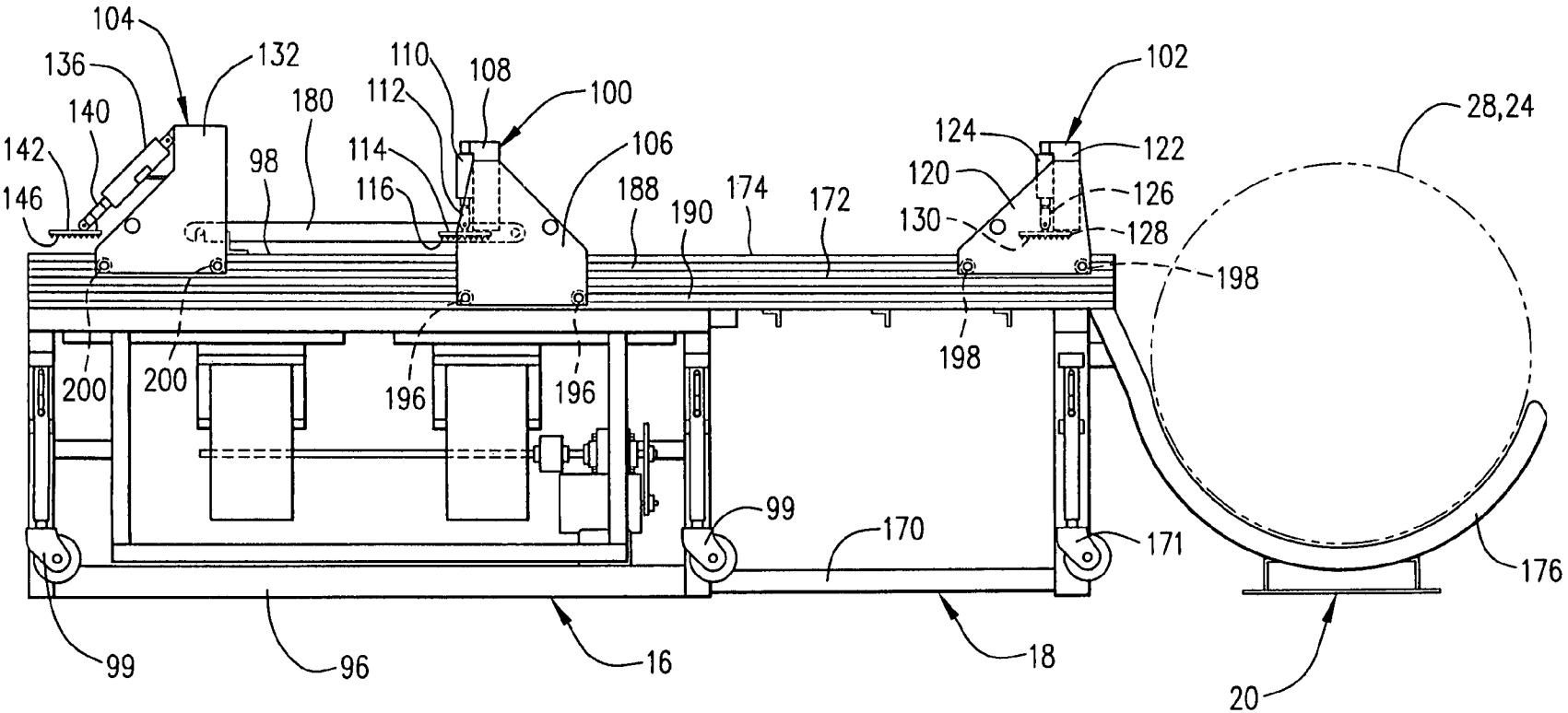

Referring now to FIGS. 2A and 3A, the details of entry conveyor 12 and heating section 14 will be discussed.

Entry conveyor 12 comprises an entry conveyor frame 30 which is detachably connected to a heating section frame 32. Positioned on entry conveyor frame 30 is an entry conveyor support 34. A plurality of entry rollers 36 are mounted on entry conveyor support 34. Previously mentioned entry roll of carpet 22 is placed on entry rollers 36. By removing a pin 31 and support members 33 and 35, conveyor support 34 can be lowered about a pivot 37 by actuating a pneumatic or hydraulic cylinder 39 to a position nearer to the ground to facilitate positioning of roll 22 thereon as shown in phantom lines in FIG. 3A. Entry conveyor support 34 has a curvilinear configuration as best seen in FIG. 3A. There is a slight rise 38 in the pattern of entry rollers 36 so that the pattern of the entry rollers curves down to a lower point 40. In this way entry roll 22 of the carpet fits on entry rollers 36 and is supported thereby with a lower portion of the carpet at lower point 40. It will be seen by those skilled in the art that the carpet may be unrolled by pulling a length 26 thereof away from the roll. The carpet will unroll while the remained rolled-up carpet rotates on entry rollers 36. Length 26 of the carpet can then be fed into heating section 14 as will be further discussed herein.

Heating section frame 32 has a plurality of castors 41 mounted thereon. Castors 41 can be lowered to engage a ground surface and thereby raise frame 32 such that it can be rolled along the ground surface. Thus, portability for heating section 14 is provided. In FIG. 3A, castors 41 are shown in a raised position in which frame 32 rests on the ground surface.

Figure 4:
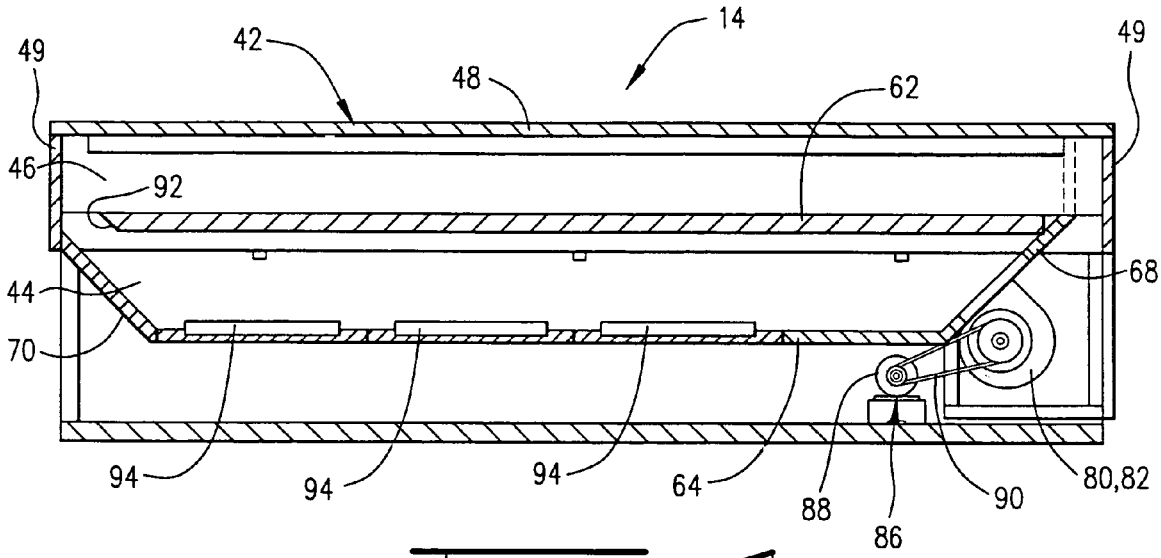
FIG. 4 is a cross-section through the heating section taken along lines 4-4 in FIG. 2A.

Heating section 14 has a duct assembly 42 disposed on heating section frame 32. Referring now also to FIG. 4, duct assembly 42 has a lower duct 44 and an upper duct 46 substantially parallel to the lower duct. Upper duct 46 includes a horizontal upper wall 48 and a pair of opposite vertical side walls 49 which extend longitudinally with respect to first embodiment 10. Extending transversely on an entry side 50 of upper duct 46 is an entry door 52. Entry door 52 is mounted on hinges 54 along its upper edge so that the entry door normally hangs downwardly in entry side 50 of upper duct 46. Similarly, an exit door 56 is disposed in an exit side 58 of upper duct 46. Exit door 56 is mounted on hinges 60 along its upper edge so that it normally hangs downwardly in exit side 58.

A substantially horizontal divider 62 separates upper duct 46 from lower duct 44, thus forming a lower surface of upper duct 46 and an upper surface of lower duct 44.

Lower duct 44 also includes a substantially horizontal lower wall 64, two outer transverse vertical side walls 66, and two angled longitudinal side walls 68 and 70. A vertical baffle 71 extends transversely through lower duct 44 between transverse side walls 66. In this way, lower duct 44 is divided into two, parallel lower duct sections 72 and 74.

Longitudinal side wall 68 defines first and second inlet ports 76 and 78 therein, respectively. It will be seen that first inlet port 76 opens into lower duct section 72, and second inlet port 78 opens into lower duct section 74. A first blower 80, of a kind known in the art is mounted in first inlet port 76 so that air discharged from the first blower enters lower duct section 72 through the first inlet port. Similarly, a second blower 82 is mounted in second inlet port 78 so that air discharged from the second blower enters lower duct section 74 through the second inlet port.

First and second blowers 80 and 82 are driven by a single shaft 84 connected to a drive train 86. In the illustrated embodiment, drive train 86 is characterized by a prime mover, such as electric motor 88, which drives shaft 84 by a belt and pulley system 90. Motor 88 is controlled by an electrical controller (not shown) of a kind known in the art.

An opening 92 is defined in divider 62 at a side thereof opposite blowers 80 and 82 so that communication is provided between lower duct 44 and upper duct 46. Referring to FIG. 4, it will be seen that air from first and second blowers 80 and 82 will flow to the left through lower duct 44, upwardly through opening 92 and to the right through upper duct 46. A plurality of heaters 94 are disposed in first and second duct sections 72 and 74 of lower duct 44 so that heated air flows through upper duct 46. The temperature of in duct assembly 42 is controlled by the speed of blowers 80 and 82. The temperature is read out on a thermometer 95. As will be discussed in more detail herein, this provides sufficient heat being applied to carpet passing through heating section 14 to soften the backing on the carpet in order to facilitate straightening in straightening section 16.

Figure 2B:
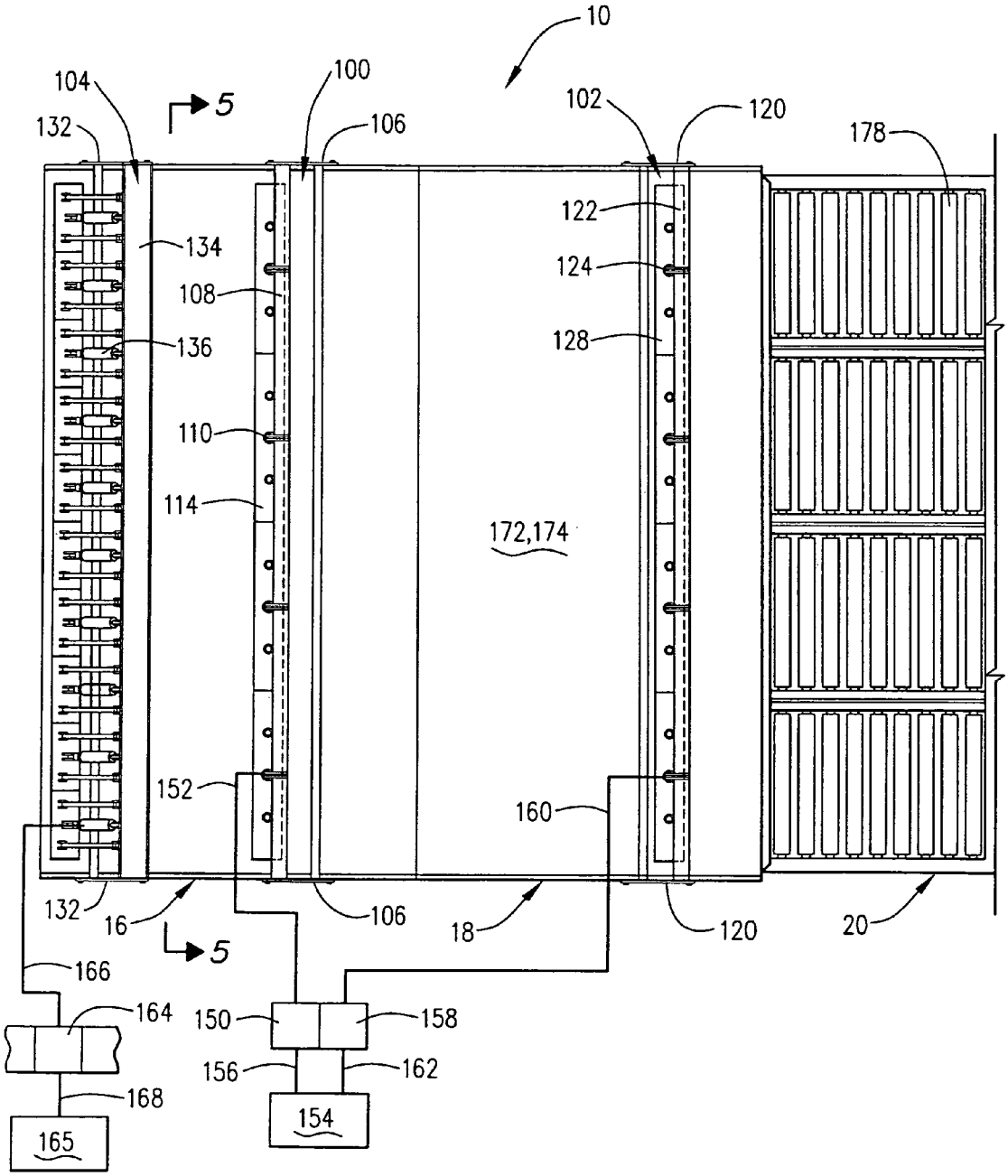

Referring now to FIGS. 2B and 3B, straightening section 16 includes a straightening section frame 96 which supports a substantially flat, horizontal straightening table 98. Straightening section 16 has a plurality of castors 99 mounted thereon which can be lowered to engage the ground surface and thus raise frame 96 to facilitate portability and movement thereof.

Mounted on table 98 are first and second clamping arrays or mechanisms 100 and 102 and a stretching or straightening array or mechanism 104. As will be discussed further herein, first and second clamping arrays 100 and 102 are used to clamp length of carpet 26 vertically while straightening array 104 pulls the carpet in a longitudinal direction away from the clamping arrays.

Figure 5:
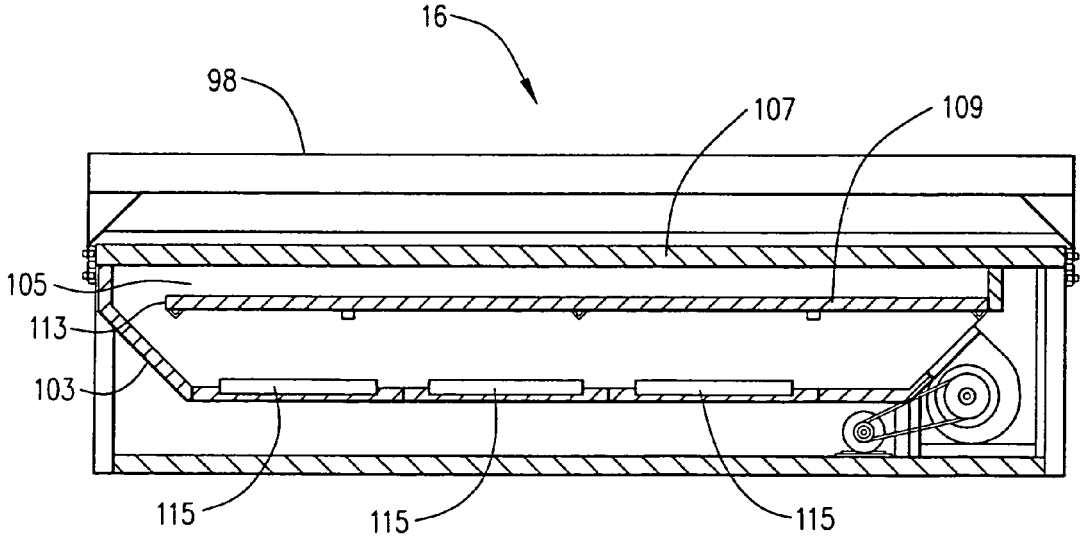
FIG. 5 shows a cross-section through the straightening section taken along lines 5-5 in FIG. 2A.

Referring to FIG. 5, straightening table 98 has a duct assembly 101 thereunder and is disposed on straightening frame 96. Duct assembly 101 has lower duct 103 and an upper duct 105 substantially parallel to the lower duct. Upper duct 105 has a horizontal upper wall 107 and is enclosed by side walls similar to upper duct 46 in heating section 14. A substantially horizontal divider 109 separates upper duct 105 from lower duct 103, thus forming a lower surface of upper duct 105 and an upper surface of lower duct 103.

In a manner similar to heating section 14, straightening section 16 utilizes blowers 111 to blow air through lower duct 103, opening 113 in divider 109, and on through upper duct 105. A plurality of heaters 115 are disposed in lower duct 103 to heat the air flowing through duct assembly 101. Blowers 111 are driven by a drive train 117 which is substantially the same as drive train 86 in heating section 14.

This system provides heat to straightening table 98 so that the carpet does not cool too quickly during the straightening operation.

Figure 6:
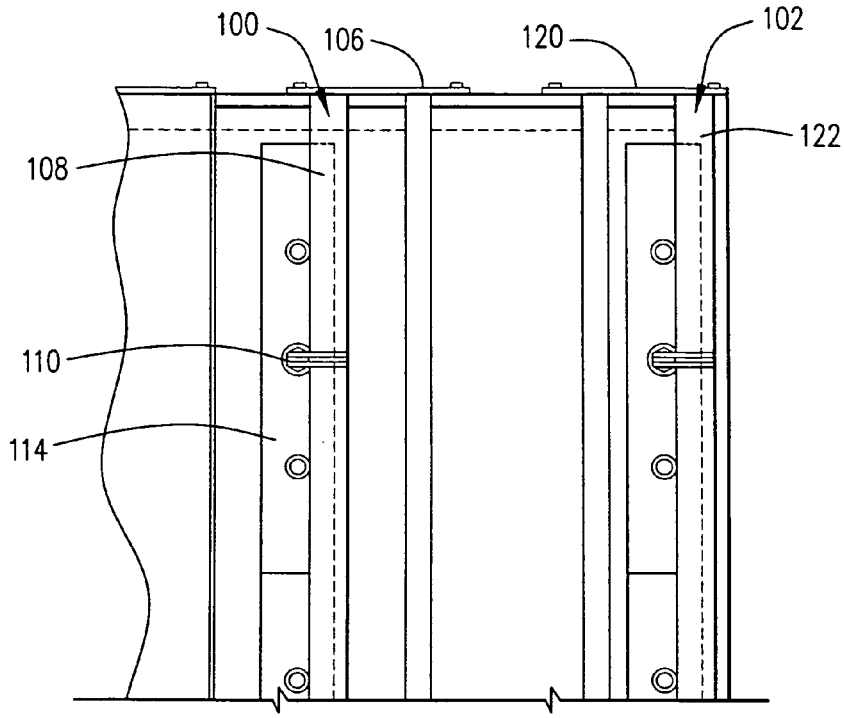
FIG. 6 shows a detail of the carpet clamping array of the first embodiment.

Referring also to FIG. 6, first clamping array 100 has a pair of transversely spaced brackets 106 mounted on table 98 with a first clamping support 108 extending therebetween. Mounted on first clamping support 108 are a plurality of hydraulic or pneumatic cylinders 110, each having a substantially vertically disposed piston 112 extending downwardly therefrom. Attached to the lower end of each piston is a flat clamping plate 114. Each clamping plate 114 is positioned substantially horizontally and has a plurality of carpet engaging teeth 116 on a lower side 118 thereof.

As best seen in FIG. 2B, clamping plates 114 are positioned closely together, as are clamping plates 128 and straightening plates 142.

Figure 7:
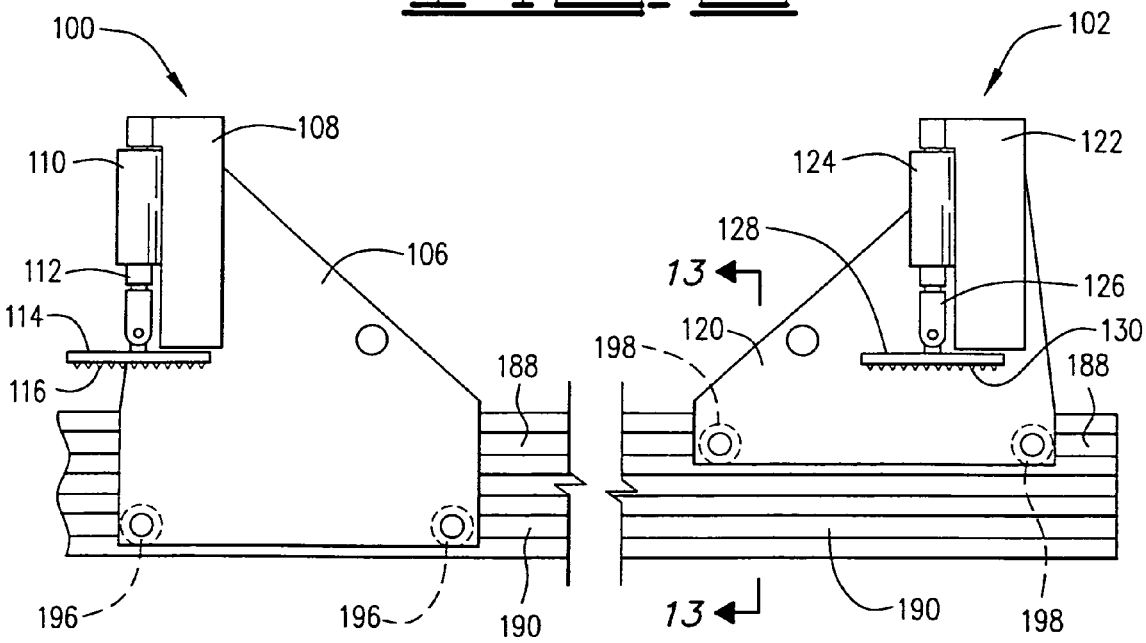
FIG. 7 is a detailed side view of the clamping array of the first embodiment.

Referring now to FIGS. 6 and 7, second clamping array 102 is also mounted on table 98 and is similar to first clamping array 100, including transversely spaced brackets 120, a second clamping support 122 extending between brackets 120, hydraulic or pneumatic cylinders 124 mounted on second clamping support 122 with pistons 126 extending downwardly from the cylinders, and clamping plates 128 attached to pistons 126 and having teeth 130 thereon.

Figure 8:
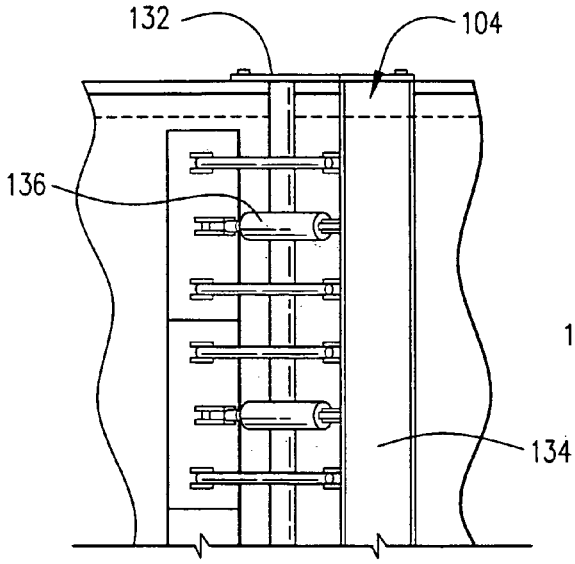
FIG. 8 shows a detail of a carpet straightening array of the first embodiment.
Figure 9:
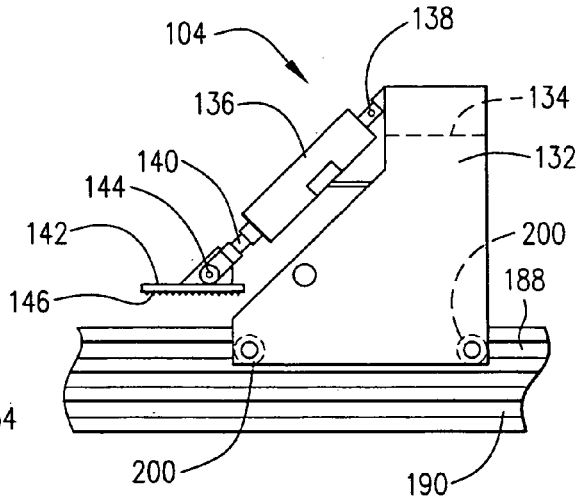
FIG. 9 is a detailed side view of the straightening array in raised position.
Figure 10:
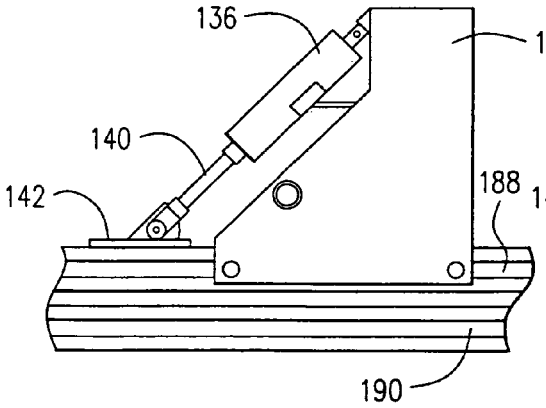
FIG. 10 illustrates the straightening array engaging the carpet.
Figure 11:
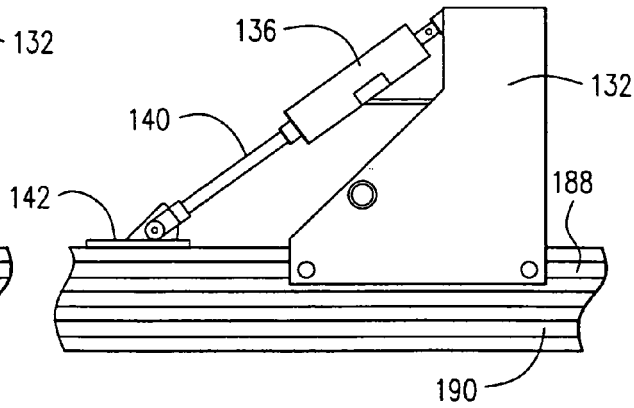
FIG. 11 shows the straightening array in an extended, stretching position.

Referring now also to FIGS. 8 and 9, straightening array 104 includes a pair of transversely spaced brackets 132 mounted on table 98 with a straightening support 134 extending transversely between the brackets. A plurality of transversely spaced hydraulic or pneumatic cylinders 136 are attached to straightening support 134 by a corresponding number of pivots 138. Cylinders 136 extend downwardly and away from straightening support 134 toward table 98. That is, cylinders 136 are at an angle with respect to straightening support 134. Each cylinder 136 has a piston 140 extending therefrom toward table 98. A straightening or stretching plate 142 is attached to the lower end of each piston 140 by a pivot 144. A plurality of carpet engaging teeth 146 are disposed on the lower side of straightening plate 142. Straightening plates 142 are substantially horizontal.

First clamping cylinders 110 are powered by hydraulic or pneumatic pressure substantially simultaneously. Second clamping cylinders 124 are also actuated substantially simultaneously by hydraulic or pneumatic pressure.

Straightening cylinders 136 are powered by hydraulic or pneumatic pressure and can be actuated individually.

Clamping cylinders 110 are connected to a corresponding control valve 150 by lines 152. Each control valve 150 is connected to a pressure source 154 of a kind known in the art by another line 156. See FIG. 3B. Clamping cylinders 124 are connected to a corresponding control valve 158 by lines 160, and control valve 158 is connected to pressure source 154 by another line 162.

Each straightening cylinder 136 is connected to a corresponding control valve 164 by a line 166, and each control valve 164 is connected to pressure source 165 by another line 168.

The sequence of actuation of first and second clamping cylinders 110 and 124, and straightening cylinders 136, will be discussed further herein.

Referring again to FIGS. 2B and 3B, cooling section 18 has a cooling section frame 170 which is detachably connected to straightening section frame 96. A cooling table 172 is supported on cooling section frame 170. Table 172 has a substantially flat, horizontally upper surface 174 which is substantially coplanar with straightening table 98.

Exit conveyor 20 is detachably connected to cooling section 18 on an opposite side thereof from straightening section 16. Exit conveyor 20 has an exit conveyor support 176 which has a curvilinear configuration when seen from the side view in FIG. 3B. Rotatably attached to exit conveyor support are a plurality of exit rollers 178. Exit conveyor 20 extends downwardly from cooling table 172 to facilitate the movement of carpet from the cooling table. That is, exit roll 28 will form in the upwardly concave exit conveyor 20.

Figure 12:
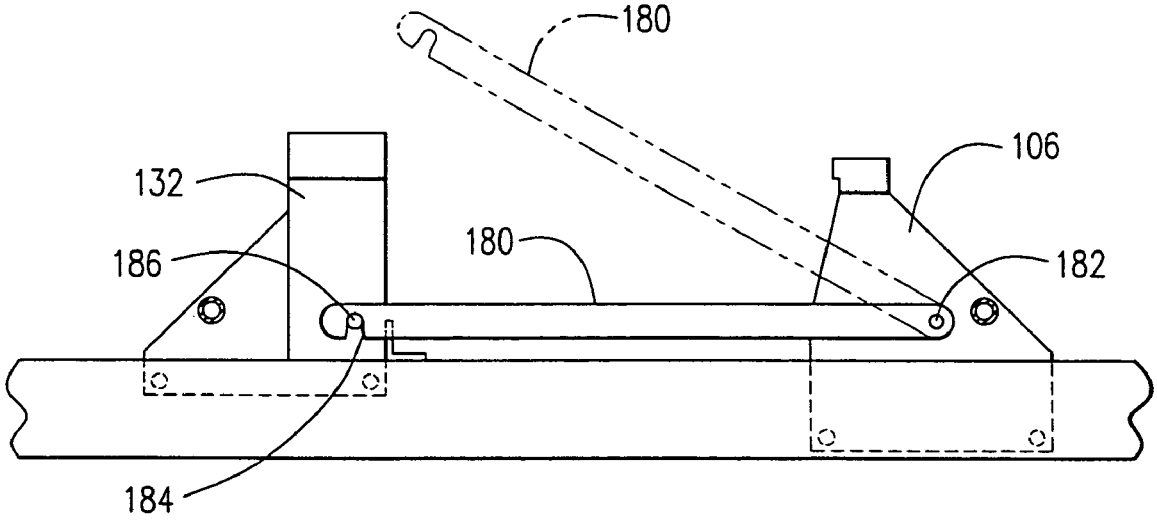
FIG. 12 is a detailed view of a locking bar of the first embodiment.

Referring now to FIG. 12, straightening array 104 can be temporarily connected to first clamping array 100 by one or more locking bars 180. A locking bar 180 is attached to at least one of brackets 132 by a pivot 182. A notch 184 defined in locking bar 180 engages a corresponding pin 186 extending from bracket 106.

Referring to FIGS. 3B, 9-11 and 13, straightening table 98 and cooling table 172 have an upper track 188 extending longitudinally along both sides of the tables and a lower track 190 substantially parallel to the upper track. Upper track 188 defines a groove 192 therein, and similarly, lower track 190 defines a groove 194 therein.

Figure 13:
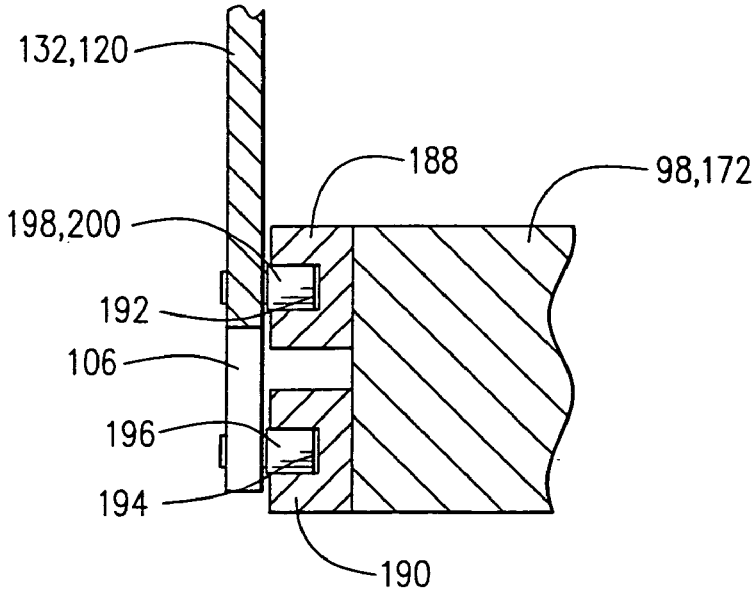
FIG. 13 is a cross-section taken along lines 13-13 in FIG. 3B showing track mounting of the straightening and clamping arrays.

As best seen in FIGS. 3B and 13, each bracket 106 of first clamping array 100 has a pair of rollers 196 mounted thereon which extend into the corresponding groove 194 of lower track 190. Thus, first clamping array 100 can be moved longitudinally along straightening table 98 and cooling table 172 on rollers 196 engaging lower track 190.

Each bracket 120 of second clamping array 102 has a pair of rollers 198 mounted thereon which extend into the corresponding groove 192 of upper track 188. Thus, second clamping array 102 can be moved longitudinally along straightening table 98 and cooling table 172 on rollers 198 engaging upper track 188.

Each bracket 132 of straightening array 104 has a pair of rollers 200 mounted thereon which extend into the corresponding groove 196 of upper track 188. Thus, straightening array 104 can be moved longitudinally along straightening table 98 and cooling table 172 on rollers 200 engaging upper track 188.

Operation of the First Embodiment

As previously mentioned, the major components of first embodiment 10 may be detachably connected to one another for easy transport. When first embodiment 10 is at the desired location, such as, but not limited to, a site near where carpet is to be installed, the apparatus is assembled as previously described. At this point, a roll 22 of carpet 24 may be positioned on entry conveyor 12 and unrolled as length of carpet 26 from the lower side of roll 22.

Length 26 is moved into heating section 14 manually by passing it through entry door 52 and into upper duct 46. Because of the overhead hinging of entry door 52, the lower edge of the entry door will engage the carpet and thereby provide enough sealing that the loss of air flowing through heating section 14 is minimal. The heated air flowing through upper duct 46 passes over the carpet. The heat generated by heaters 94 is sufficient to soften the backing on the carpet without melting it.

After the carpet is heated sufficiently, it is moved out of upper duct 46 through exit door 56. Similar to entry door 52, the overhead hinging of exit door 56 provides sealing by engagement of the lower edge of the door with the carpet.

The heated carpet is moved onto table 98 in straightening section 16. The carpet is visually inspected to determine whether and how much straightening is required. The heating from heaters 115 in straightening section 16 heats straightening table 98 and thereby keeps the carpet from cooling down too quickly during a straightening operation.

Figure 14:
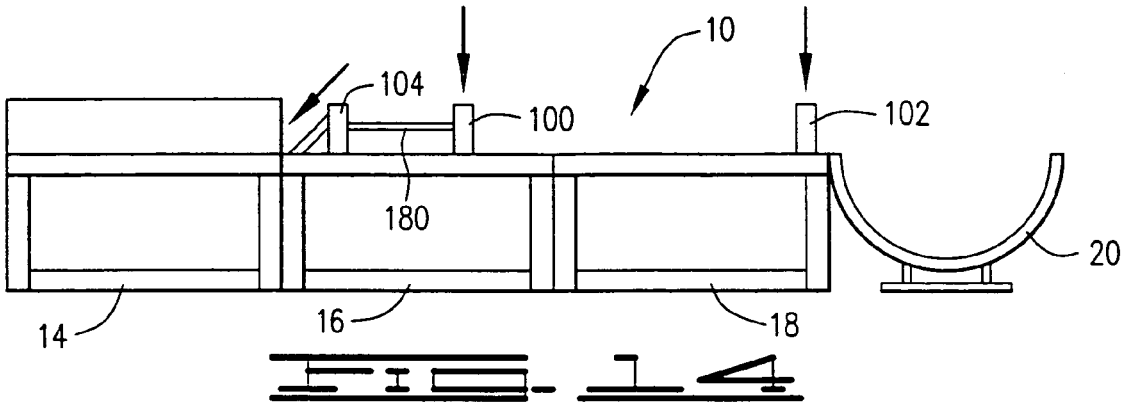
FIGS. 14-17 illustrate a straightening operation cycle using the first embodiment of the apparatus.

FIGS. 3B and 14 illustrate first embodiment 10 at the beginning of a straightening cycle. Straightening array 104 is positioned longitudinally close to heating section 14, and locking bar 180 is used to lock the straightening array to first clamping array 100. The distance between straightening array 104 and first clamping array 100 is set by the length of locking bar 180. In this initial position, second clamping array 102 is positioned at the end of cooling section 18 nearest exit conveyor 20.

When it is determined that a portion of the carpet needs correction, first and second clamping plates 114 and 128 are moved downwardly into engagement with flat length of carpet 26 by actuating cylinders 110 and 124, respectively, as previously described. Once the carpet is held firmly in place by clamping plates 114 and 128, the operator may bring straightening plates 142 into engagement with the still heated carpet by actuating straightening cylinders 136. Because of the angled orientation, straightening plates 142 pull the carpet in a longitudinal direction away from clamping arrays 100 and 102. The forces applied are represented by arrows in FIG. 14. It is important to understand that the actuation of straightening cylinders 136 is individually controlled by the corresponding control valves 164 so that only that portion of the carpet which needs to be stretched to straighten the pattern therein is actually stretched. Thus, great versatility is provided to the operator to clamp and stretch the desired portion of the carpet and no more.

Figure 15:
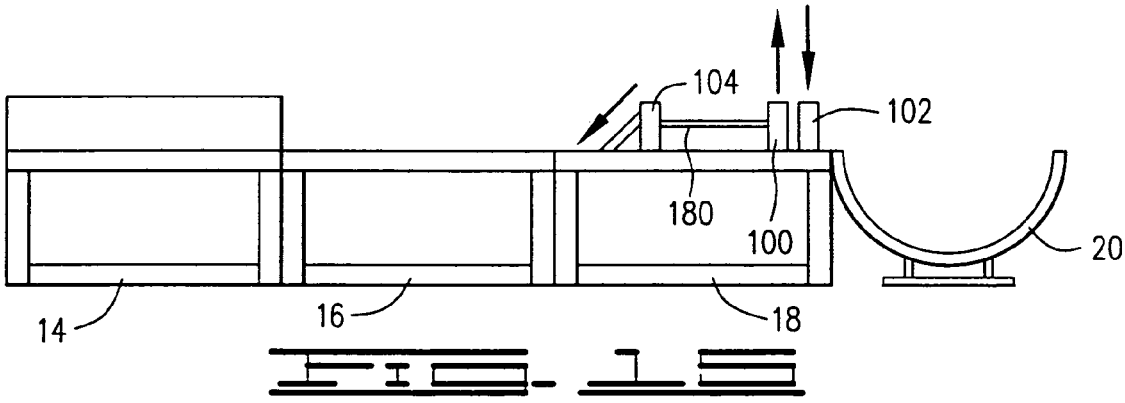

When the pattern is straightened sufficiently, clamping plates 128 of second clamping array 102 are raised. First clamping array 100 and straightening array 104, which are locked together by locking bar 180, are then moved together toward second clamping array 102, along with the portion of carpet clamped. See FIG. 15. Even though straightening array 104 and first clamping array 100 are still clampingly engaged with the carpet, the carpet will still slide along the smooth, substantially continuous surfaces of straightening table 98 and cooling table 172. Second clamping array 102 is again moved to its clamping position.

Figure 16:
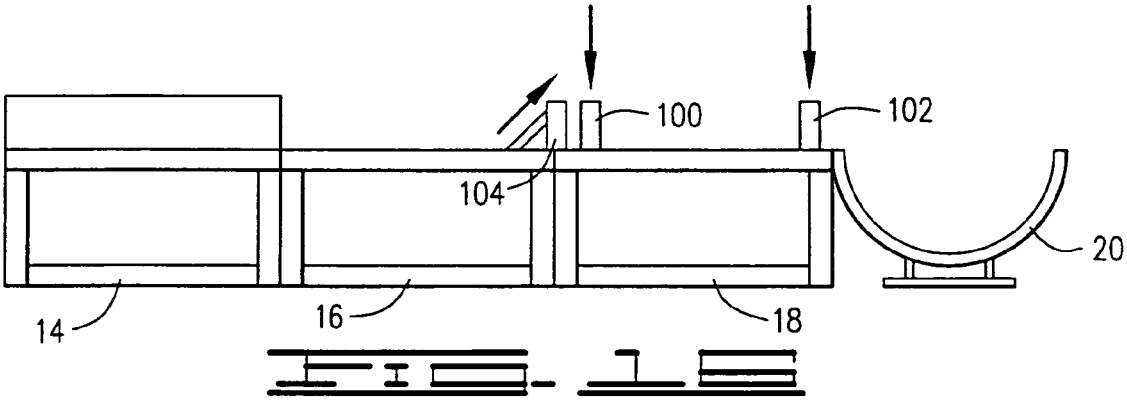

Locking bar 180 is disengaged from first clamping array 100, and the first clamping array is moved away from second clamping array 102 and toward straightening array 104. See FIG. 16. First clamping array 100 is again engaged with the carpet, and straightening array 104 is disengaged as indicated by the arrows in FIG. 16. Straightening array 104 can then be moved back to its initial position adjacent to heating section 14.

Figure 17:
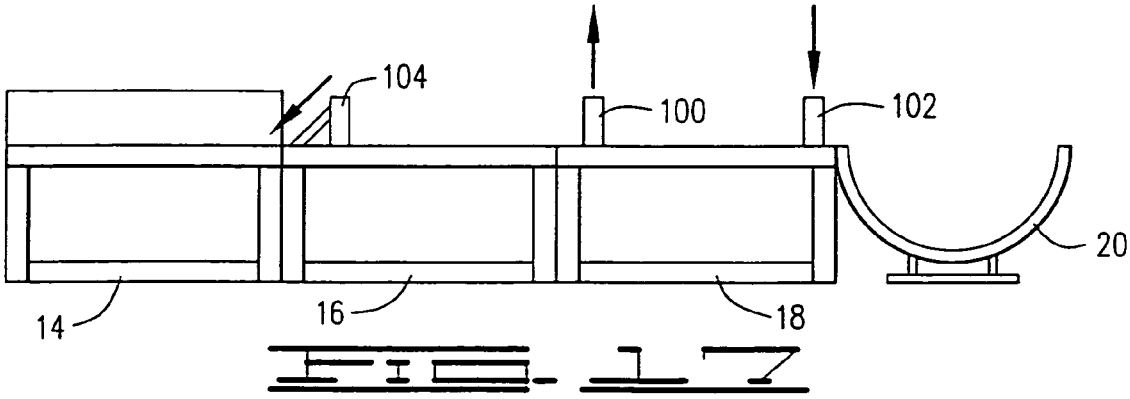
Figure 11:
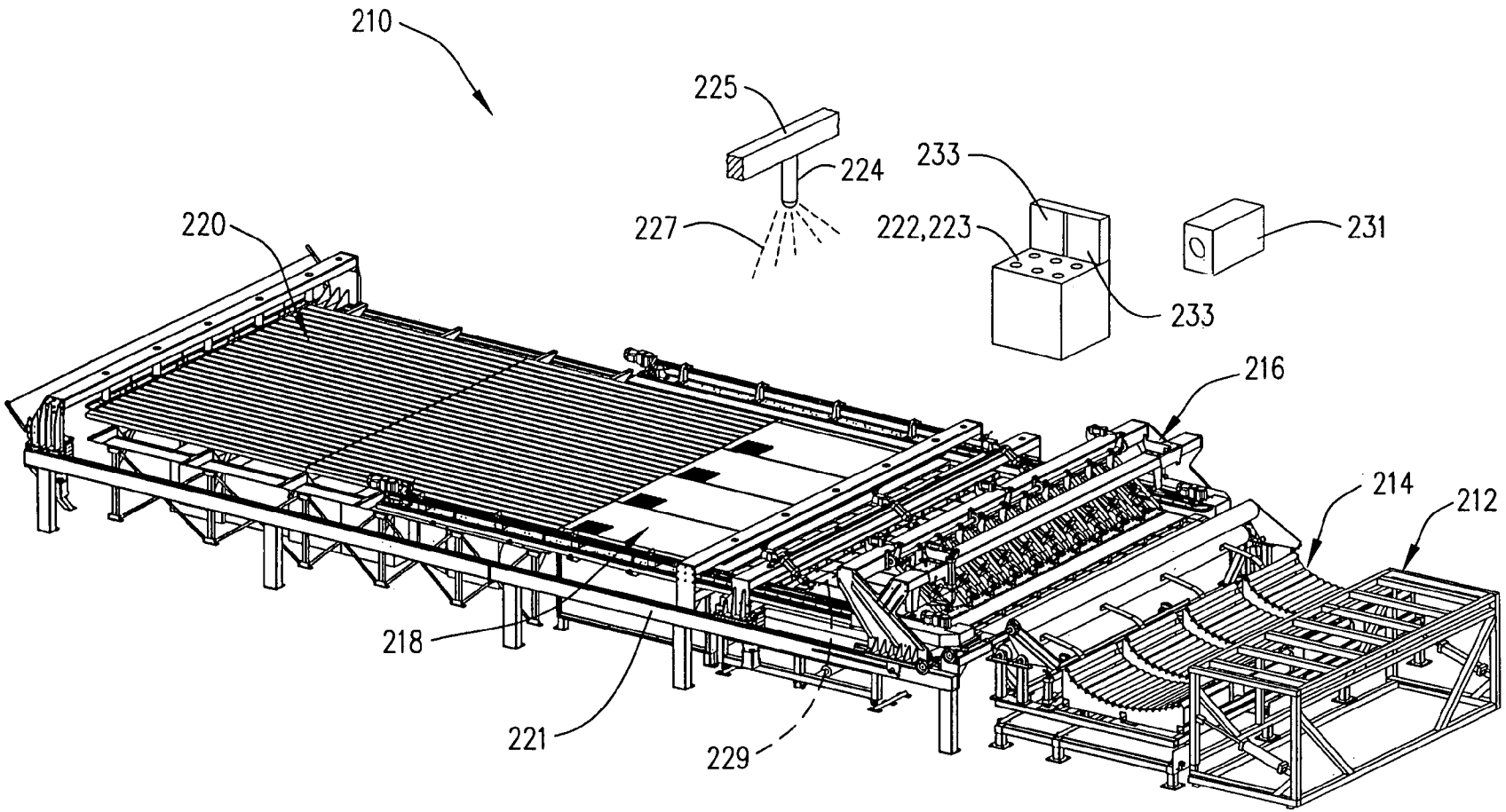
Figure 15:
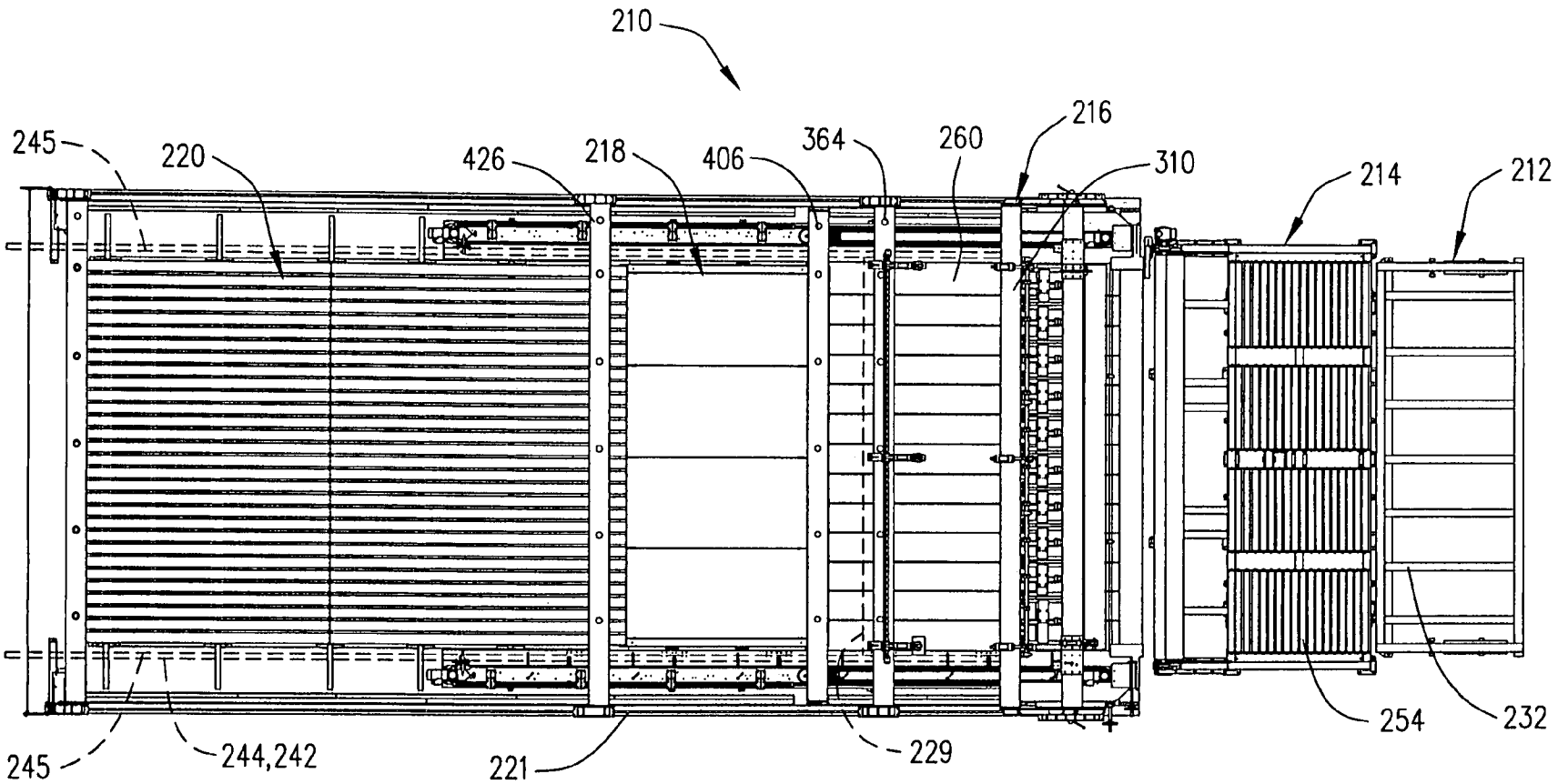

At this point, straightening array 104 is again engaged with the carpet, and first clamping array 100 is disengaged as indicated by the arrows in FIG. 17. First clamping array 100 can be moved toward straightening array 104 and locking bar 180 re-engaged with the first clamping array to restart the cycle.

It will be seen that at all times during this cycle, at least two arrays are clampingly engaged with the carpet so that the stretching forces continue to hold the carpet in the stretched position.

By the time the cycle is ready to be repeated, the carpet will have cooled enough so that the backing has at least begun to harden back to its normal consistency. The straightened carpet will then remain in its corrected form. After cooling, the carpet is moved onto exit conveyor 20 where it can be rolled back up into exit roll 28.

The straightened roll of carpet may then be removed from first embodiment 10 and transported to the installation location. Because the pattern has been straightened on first embodiment 10, manual straightening on the floor by the operator is greatly reduced or eliminated. This greatly lowers operating costs and fatigue for the operator. It also allows much more carpet to be installed in the same amount of time compared to prior manual techniques.

Description of the Second Embodiment

Figure 18:
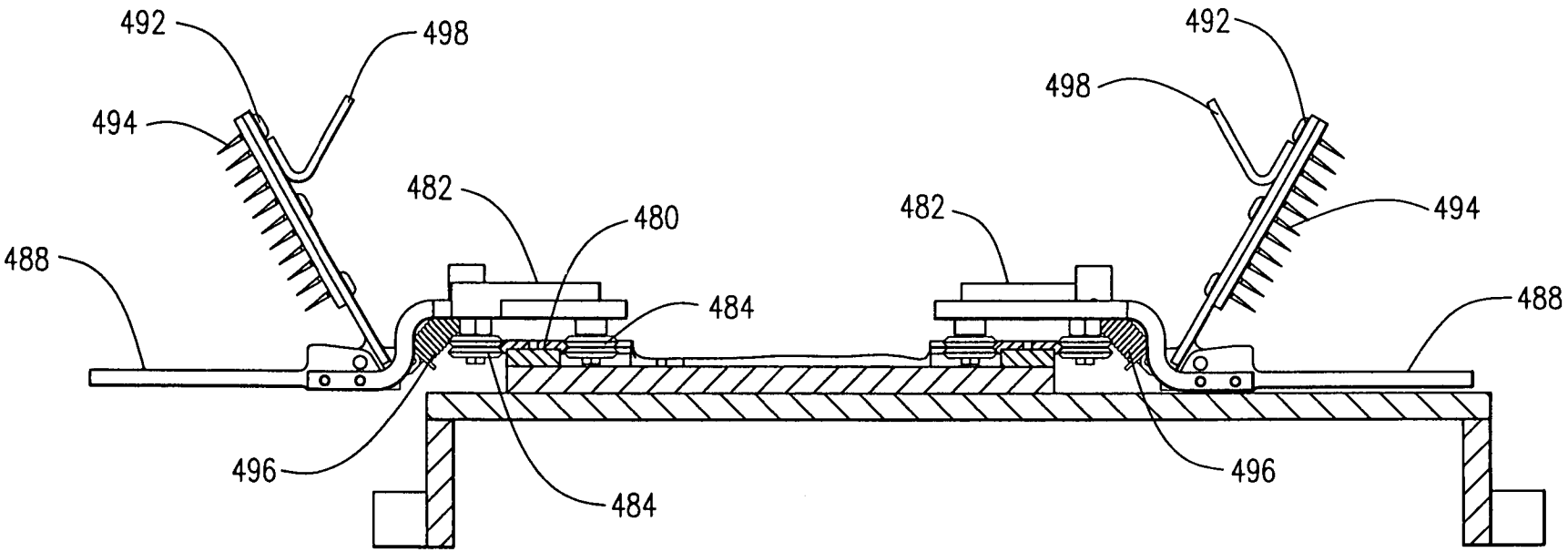
FIG. 18 is a perspective view of a second embodiment of the carpet straightening apparatus of the present invention.

Referring now to the drawings, and more particularly to FIG. 18, a second embodiment of the carpet straightening apparatus of the present invention is shown and generally designated by the numeral 210.

The major components of second embodiment 210 are a queue station 212, an unwind section 214, a heating and straightening section 216, a cooling section 218 and an exit section 220 generally supported by a support or frame 221. Support or frame 221 itself may actually include more than one individual component. Second embodiment 210 also comprises a control system 222 with a control panel 223 and various electronic, hydraulic and pneumatic systems therein or connected thereto. Also forming a portion of control system 222 is one or more computers (not shown), the visual output of which can be seen on one or more screens 233 on control panel 223.

A laser 224 is positioned above heating and straightening section 216 and is attached to and supported by a member 225. Member 225 may be a portion of a ceiling or other cover above apparatus 210 or directly attached thereto in some manner known in the art. Laser 224 is used to project laser beam 227 downwardly toward heating and straightening section 216 such that a laser image line 229 is formed in a manner more fully described subsequently herein. At least one video camera 231 is positioned adjacent to heating and straightening section 216 to record line 229 and any adjacent portion of carpet 244 and transmit an image to control system 222 so that it can be seen on a screen 233 on control panel 223.

Figure 20:
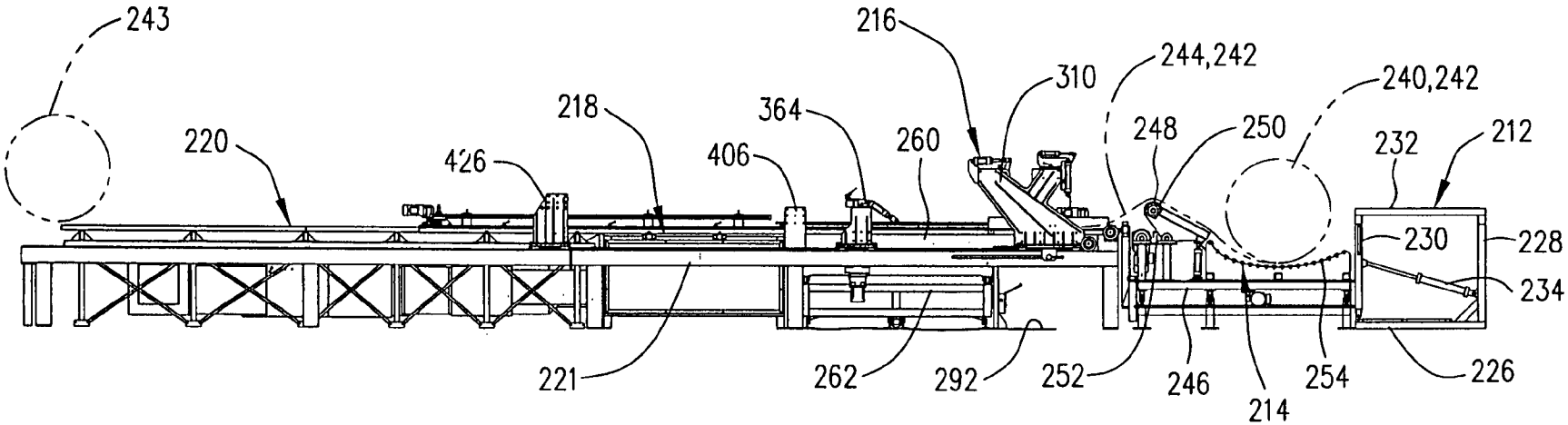
FIG. 20 is a side elevation view of the second embodiment.

Referring also to FIGS. 19 and 20, queue station 212 is adapted for holding a roll 240 of carpet 242 thereon and loading it onto unwind section 214. Queue station 212 comprises a frame 226 with a pair of fixed, outer legs 228 and a pair of telescoping, inner legs 230 adjacent to unwind section 214 that support a rack 232. Hydraulic or pneumatic cylinders 234 are connected between fixed legs 228 and telescoping legs 230. In the drawings, rack 232 is shown in a horizontal position.

Roll 240 of carpet 242 may be loaded onto rack 232 while in this position in any manner known in the art, such as by forklift, hoist, etc.

By actuating cylinders 234 so that they retract, it will be seen by those skilled in the art that telescoping legs 230 will be shortened so that rack 232 is tilted downwardly toward unwind section 214. Thus, any roll 240 of carpet 242 that has been previously placed on horizontal rack 232 will roll onto unwind section 214 when cylinders 234 are actuated as described above. Rack 232 can be returned to its horizontal position by actuating cylinders 234 in the opposite description. Cylinders 234 themselves are of a kind generally known in the art.

Unwind section 214 has an entry conveyor 238 that is adapted for receiving entry roll 240 of carpet 242 thereon from queue station 212. Carpet 242 can be unrolled in place on entry conveyor 238 of unwind section 214 and pulled along as an extended length 244 of carpet 242. Carpet 242 usually has a border or tenter 245 along the opposite longitudinal sides thereof, as seen in FIG. 19.

As will be further described herein, length 244 of carpet 242 passes through heating section and straightening section 216, over cooling section 218 and onto exit section 220 after which the carpet is wound back into a roll 243 again which may be referred to as exit roll 243.

Entry conveyor 238 of unwind section 214 is mounted on an entry conveyor frame 246 that has a generally curvilinear configuration. On the opposite side of entry conveyor 238 from queue station 212 is a nip roller 248. Nip roller 248 has a plurality of small teeth 250 thereon that are adapted to engage the lower side of length 244 of carpet 242. Nip roller 248 is powered by a roller drive system 252 mounted to entry roller frame 246. When energized, drive system 252 turns nip roller 248 in a counterclockwise direction as seen in FIG. 20. Because of the engagement of teeth 250 with carpet 242, length 244 of the carpet will be pulled so that the carpet is unwound from roll 240 and fed toward heating and straightening section 216. The carpet will unroll while the remaining rolled-up carpet rotates on rollers 254 of entry conveyor 238.

Heating and straightening section 216 comprises a straightening area 260 on which length 244 of carpet 242 is received. Straightening area 260 has a plurality of longitudinally extending wires or rods 261 that support length 244 of carpet 242 thereon above a heating system 262. See also FIG. 21. As will be further described herein, length 244 of carpet 242 is thus laid out substantially horizontally over straightening area 260, and even though straightening area 260 does not have a flat surface at the upper side thereof, the supporting action of wires 262 is such that straightening area 260 may still also be referred to as a straightening table 260.

Figure 21:
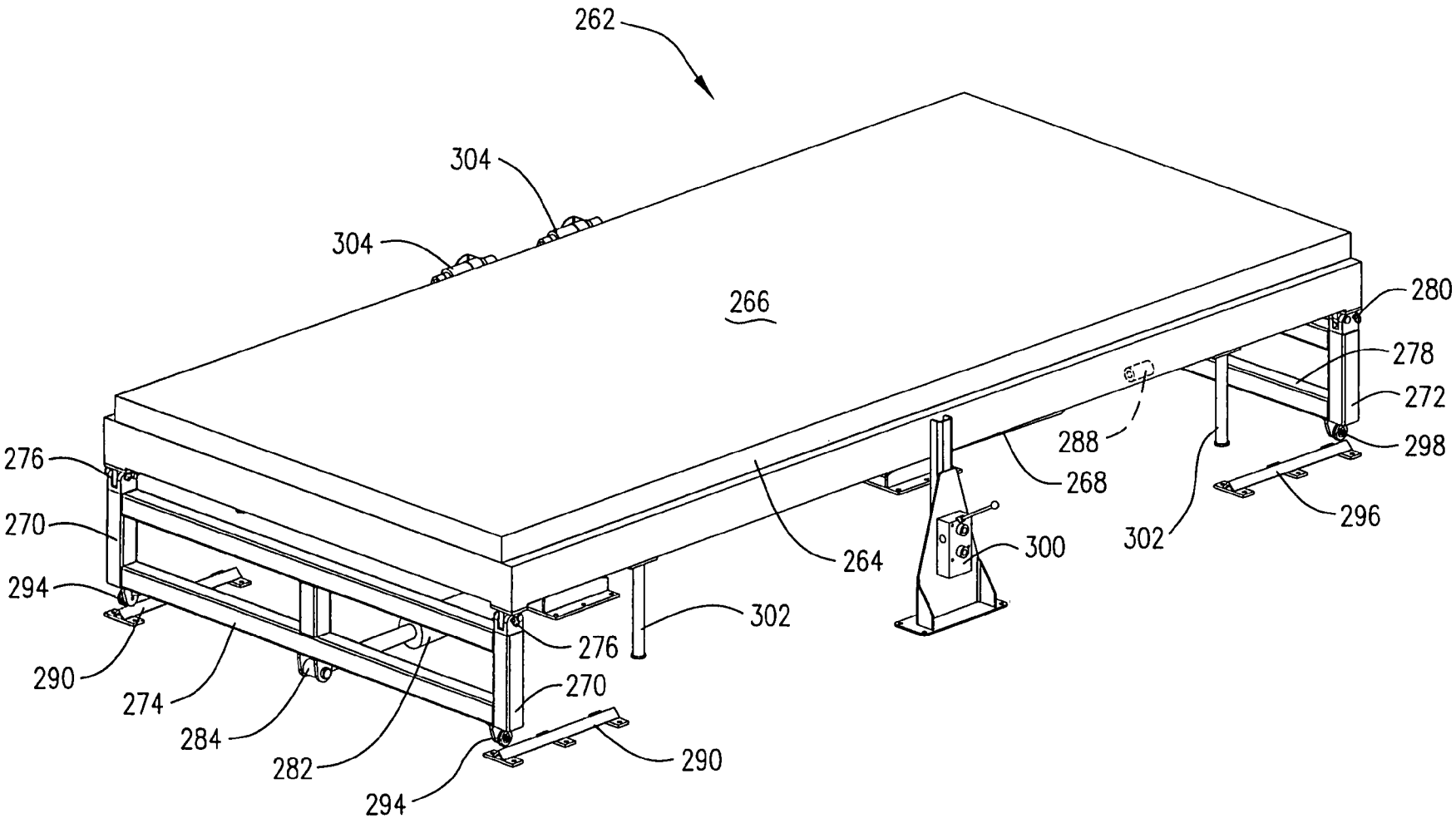
FIG. 21 shows a perspective of the heating system in the second embodiment.
Figure 12:
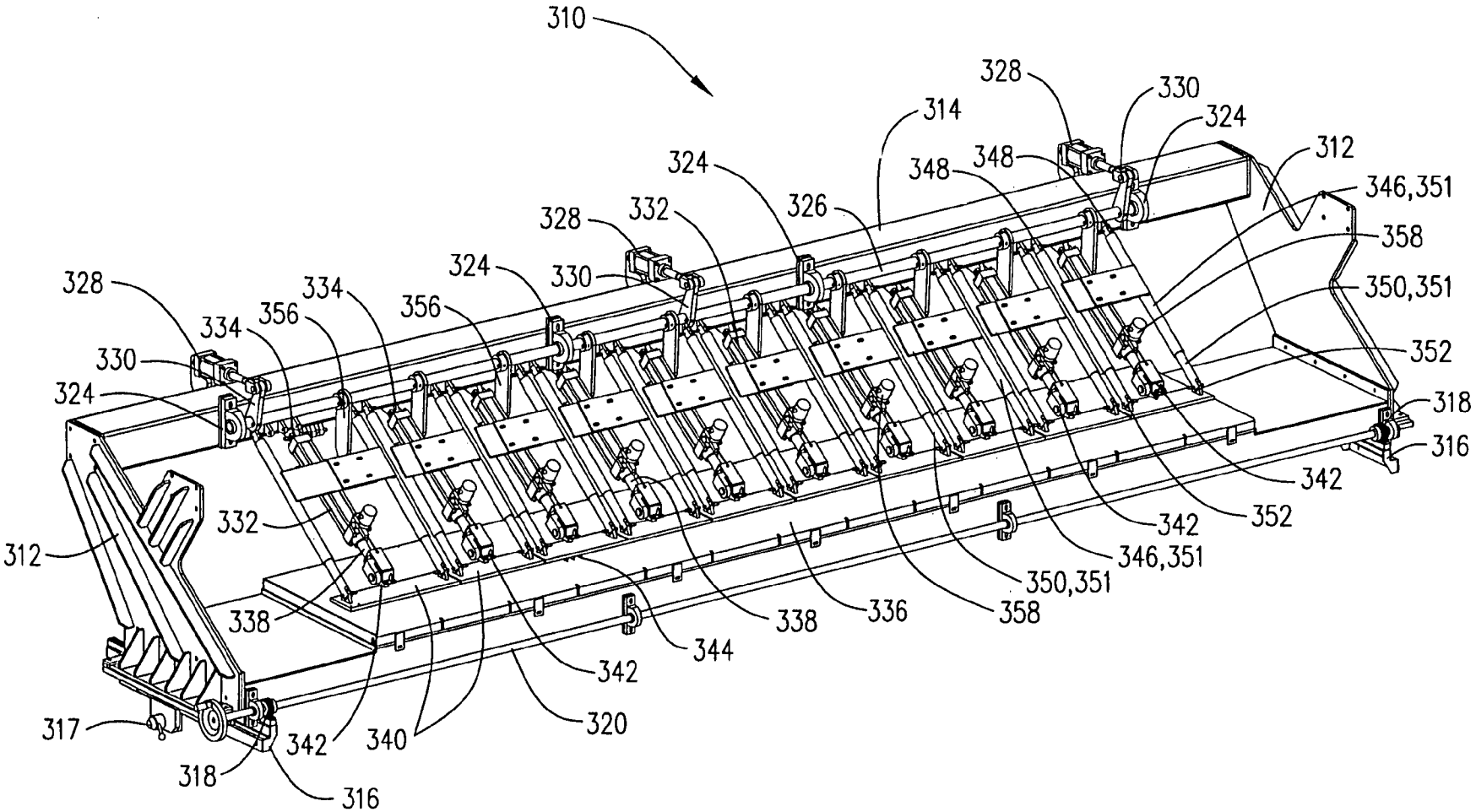
Figure 23:
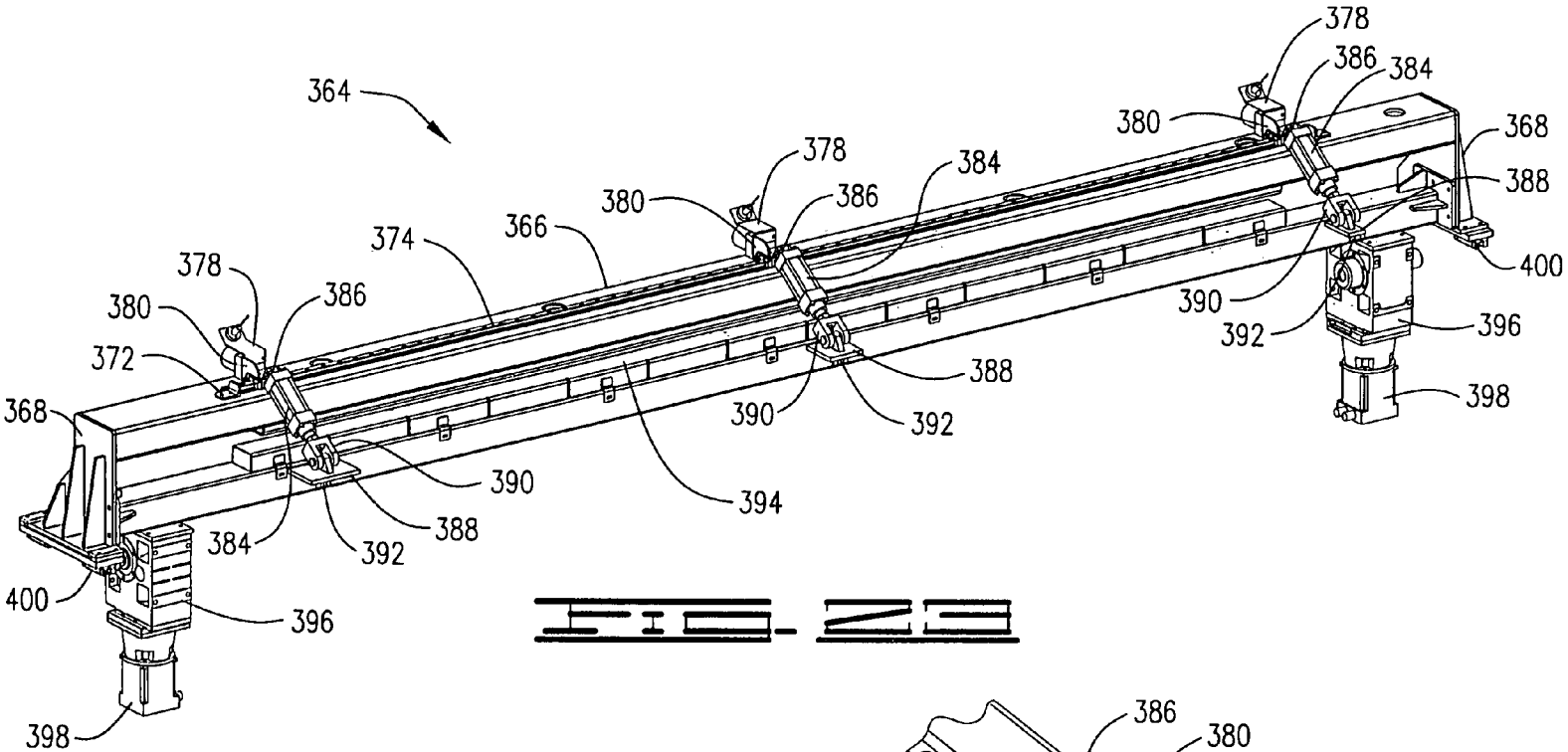
FIG. 23 illustrates a perspective of a holding clamp assembly.
Figure 24:
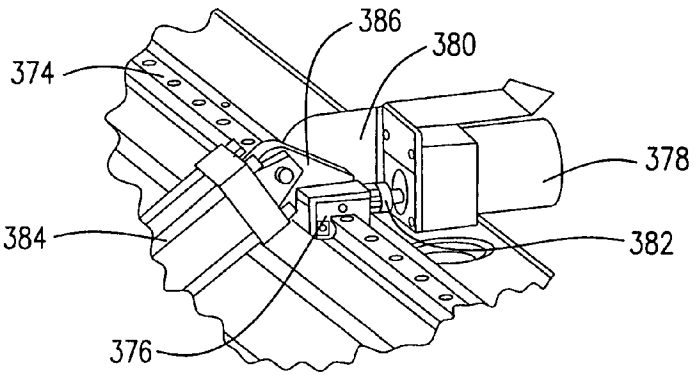
FIG. 24 shows a detailed portion of the holding clamp assembly of FIG. 23.

Referring still to FIG. 21, heating system 262 comprises an infrared oven 264 that defines a heating surface 266 on the upper portion thereof. Oven 264 is supported on a frame 268 having a pair of legs 270 extending downwardly from at one side thereof and another pair of legs 272 extending downwardly from the other side of the frame. Legs 270 are connected by a cross member 274 and connected to frame 268 by pivots 276. Similarly, legs 272 are connected by a cross member 278 and connected to frame 268 by pivots 280.

A pneumatic or hydraulic cylinder 282 is mounted under frame 268 and is connected to cross member 274 by a pivot 284, and another pneumatic or hydraulic cylinder 286 is mounted under frame 268 and connected to cross member 278 by a pivot 288.

Legs 270 are supported on tracks 290 on a ground surface 292 by wheels 294. Legs 272 are supported on tracks 296 on ground surface 292 by wheels 298.

Cylinders 282 and 286 are controlled by a pneumatic or hydraulic controller 300. By actuating cylinders 282 and 286 so that they retract, it will be seen by those skilled in the art that legs 270 and 272 are pivoted below frame 268 and oven 264 so that wheels 294 and 298 move along tracks 290 and 296, respectively, to lower the frame and oven. Supports 302 limit this downward movement.

The amount of heat and the duration thereon may also be varied as necessary In these ways, the heating of length 244 of carpet 242 can be controlled. Infrared temperature detectors 304 provide a means for determining the actual temperature of oven 264. The operator can see this information on control panel 223 and vary the temperature as desired.

Oven 264 provides sufficient heat to straightening area 260, and thus to length 244 of carpet 242 passing through heating and straightening section 216, to soften the backing on the carpet in order to facilitate straightening it. The amount of heat necessary will vary with the type of backing on the carpet and with the size and thickness of the carpet.

Referring now to FIGS. 18-20 and 22, a working head assembly 310 is disposed above straightening area 260. Working head assembly 310 comprises a pair of spaced side plates 312 with a top member 314 extending therebetween. Each side plate 312 is above a gear rack 316 attached to opposite sides of straightening area 260 and is lockable by rotating a locking handle 317. A pair of pinion gears 318 interconnected by a shaft 320 engage corresponding gear racks 316.

A crank handle 322 is attached to one end of shaft 320 so that the shaft can be manually rotated. It will be seen that rotation of crank handle 322 and shaft 320 results in rotation of pinion gears 318 and linear movement of working head assembly 320 along gear racks 316. Thus, working head assembly can be moved back and forth longitudinally with respect to straightening area 260.

Mounted on top member 314 of working head assembly 310 are bearings 324 that support a cylinder control shaft 326. A plurality of hydraulic or pneumatic shaft actuation cylinders 328 are mounted on top member 314 and are interconnected with cylinder control shaft 326 by linkages 330. It will be seen that cylinder control shaft 326 can be rotated in either direction by actuating shaft actuation cylinders 328 in or out.

A plurality of transversely spaced hydraulic or pneumatic working cylinders 332 are attached to top member 314 by a corresponding number of pivots 334. Working cylinders 332 extend downwardly and away from top member 314 toward a working surface or table 336 that is adjacent to heating surface 266. That is, working cylinders 332 are at an angle with respect to top member 314 and working surface 336. Each working cylinder 332 has a piston 338 extending therefrom toward working surface 336. A straightening or working plate 340 is attached to the lower end of each piston 338 by a pivot 342. A plurality of carpet engaging teeth 344 are disposed on the lower side of each working plate 340. Working plates 340 are substantially horizontal and parallel to working surface 336.

Disposed on opposite sides of each working cylinder 332 are a plurality of female guide tubes 346 connected to top member 314 by corresponding pivots 348. Slidably disposed in each female guide tube 346 is a male guide tube 350. Thus, a plurality of telescoping female/male guide assemblies 351 are formed. A bracket 354 connects each working cylinder 332 with the corresponding female guide tubes 346 on opposite sides thereof.

Working cylinders 332 are also fixedly attached to cylinder control shaft 326 by an arm 356 so that when the cylinder control shaft is rotated, working cylinders 332 and working plates 340 can be raised and lowered with respect to working surface 336. This is accomplished by actuating shaft actuation cylinders 328 as previously described. Female guide tubes 346 and male guide tubes 350 serve to guide working cylinders 332 and substantially prevent transverse movement of working plates 340. That is, working cylinders 332 will control movement of working plates 340 only in a substantially longitudinal direction as will be further described herein.

As will also be further described, working cylinders 332 can be individually actuated, and a linear position transducer 358 is provided to send a signal to the operator indicating the longitudinal position of the corresponding working cylinder 332 and working plate 340.

Referring now to FIGS. 18-20, 23 and 24, a holding clamp assembly 364 is positioned above straightening area 260 and spaced from working head assembly 310.

Holding clamp assembly 364 comprises an upper bar 366 extending between a pair of side plates 368. A lower bar 370 also extends between side plates 368 below upper bar 364.

A transversely extending gear rack 372 is mounted on the top of upper bar 366, and a guide rail 374 is positioned adjacent and parallel to gear rack 372. A plurality of rail runner blocks 376 are engaged with guide rail 374 and guided thereby. A motor 378 is attached to each rail runner block 376 by a bracket 380. Each motor 378 is adapted to drive a gear 382 that engages rear rack 372. By actuating motors 378, rail runner blocks 376 can be moved along gear rack 372, and the engagement of the rail runner blocks with guide rail 374 keeps the rail runner blocks properly aligned as they move adjacent to upper bar 366.

A hydraulic or pneumatic holding cylinder 384 is connected to each bracket 380 by a pivot 386. It will be seen that holding cylinders 384 thus move with rail runner blocks 376 as described above.

A holding plate 388 is attached to each holding cylinder 384 by a pivot 390. Carpet gripping teeth 392 are disposed on the lower side of each holding plate 384.

Lower bar 370 of holding clamp assembly 364 has an upwardly facing holding surface 394.

A gearbox 396 is mounted to the lower side of lower bar 370 at each end thereof adjacent to side plates 368. A servo motor 398 drives and is connected to each gearbox 396. A linear runner 400 is disposed on the lower side of each side plate 368 and is adapted to engage frame 221 and drive holding clamp assembly 364 therealong.

Figure 25:
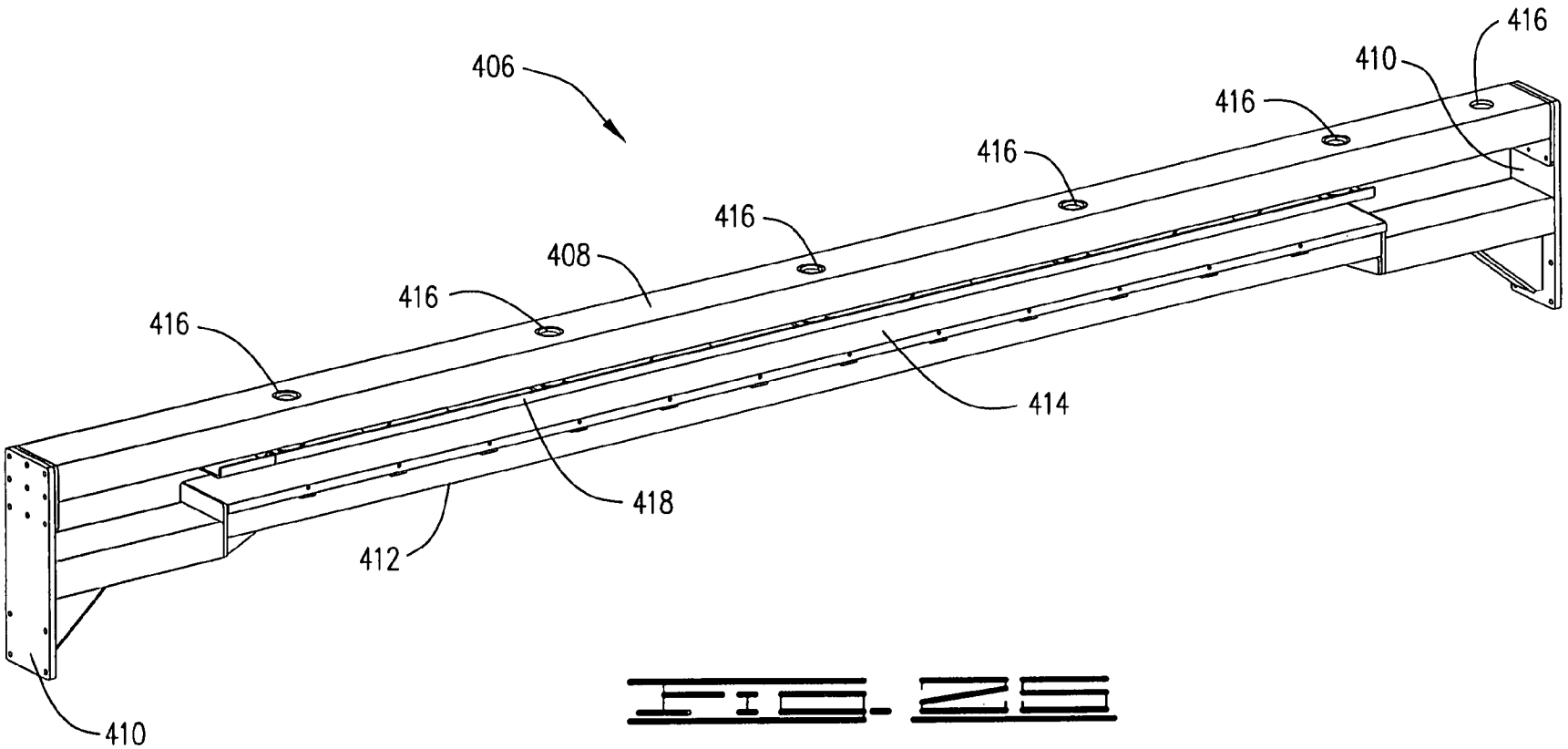
FIG. 25 is a perspective view of a primary clamp assembly.
Figure 25:
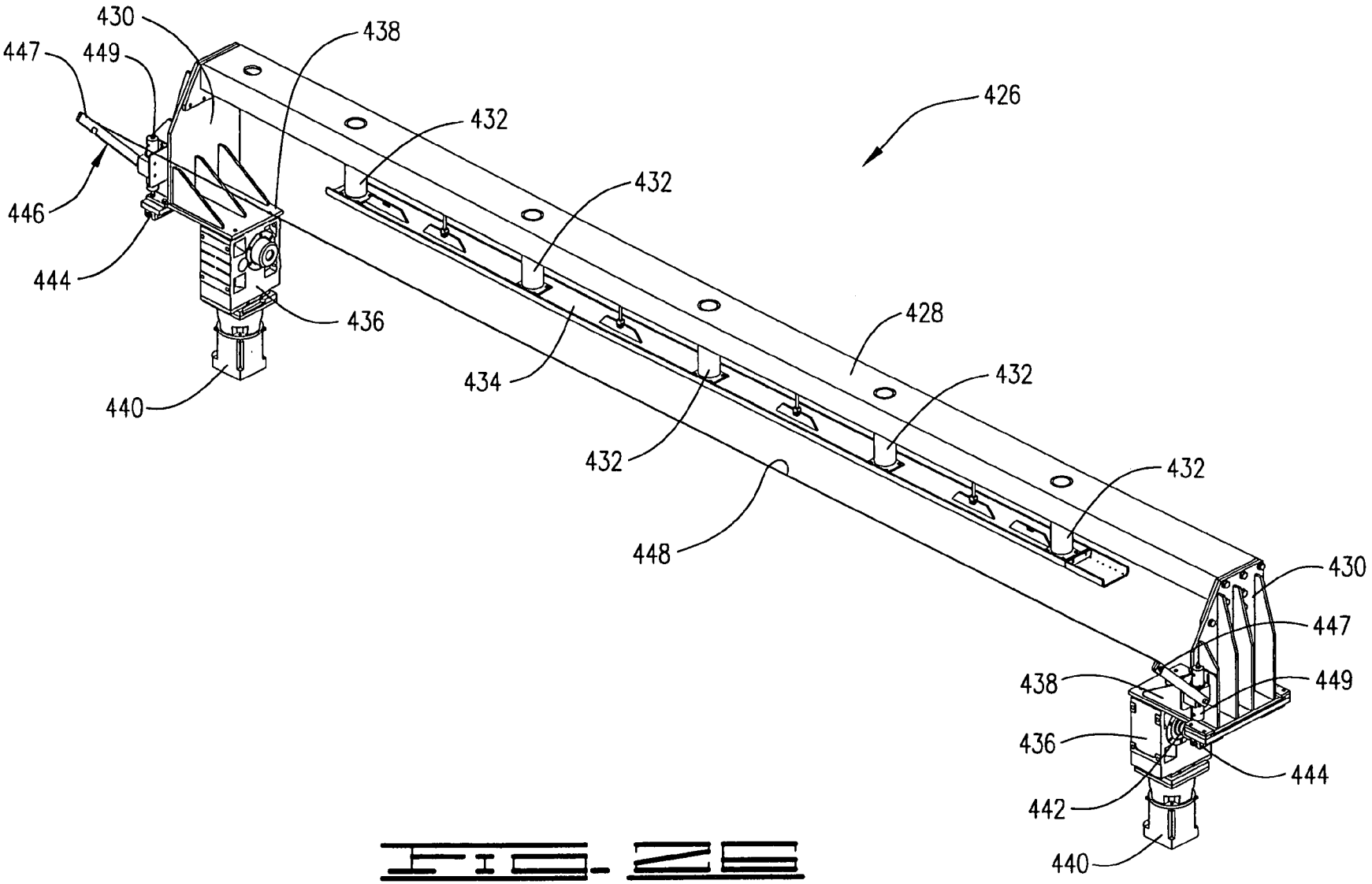

Referring again to FIGS. 18-20, a primary clamp assembly 406 is disposed above the connection between heating and straightening section 216 and cooling section 216. The details of primary clamp assembly 406 are shown in FIG. 25.

Primary clamp assembly 406 has an upper bar 408 extending between side plates 410. Side plates 410 are fixedly attached to frame 221. A lower bar 412 also extends between side plates 410 and below upper bar 408. Lower bar 412 has a working surface 414 thereon.

A plurality of hydraulic or pneumatic gripper cylinders 416 are disposed in upper bar 410 and are adapted to actuate downwardly therefrom. A gripper 418 is connected to gripper cylinders 416. Gripper 418 generally faces working surface 414 on lower bar 412. Rather than the single gripper 418 shown in FIG. 25, a plurality of grippers could also be used.

Referring again to FIGS. 18-20, a pulling clamp assembly 426 is disposed on frame 221. The details of pulling clamp assembly 426 are shown in FIG. 26.

Primary clamp assembly 426 has an upper bar 428 extending between side plates 430. Side plates 430 are fixedly attached to frame 221.

A plurality of hydraulic or pneumatic pulling cylinders 432 are disposed in upper bar 430 and are adapted to actuate downwardly therefrom. A pulling clamp 434 is connected to pulling cylinders 432. Pulling clamp 434 faces downwardly. Rather than the single pulling clamp 434 shown in FIG. 26, a plurality of pulling clamps could be used.

A gearbox 436 is mounted to each of side plates 430 with a corresponding bracket 438. A servo motor 440 drives and is connected to each gearbox 436. A spur gear 442 is located on the outboard side of each gearbox 436 and is driven by servo motor 440 and gearbox 436. Spur gears 442 are adapted to engage gear racks 316 on opposite sides of apparatus 210 to move pulling clamp assembly 426 longitudinally. A linear runner 444 is disposed on the lower side of each side plate 430 and is adapted to engage frame 221 to guide pulling clamp assembly 426 as it moves.

Attached to the rear side of pulling clamp assembly 426 is a correction reference assembly 446 that comprises a pair of arms 447 with a string or wire 448 stretched therebetween. Correction reference assembly 446 has an upper position best seen FIG. 26 and a lowered position in which arms 447 are substantially horizontal and string 448 is adjacent to the surface of carpet 242 therebelow. Arms 447 are moved between these two positions by a pair of corresponding actuators 449.

Figure 27:
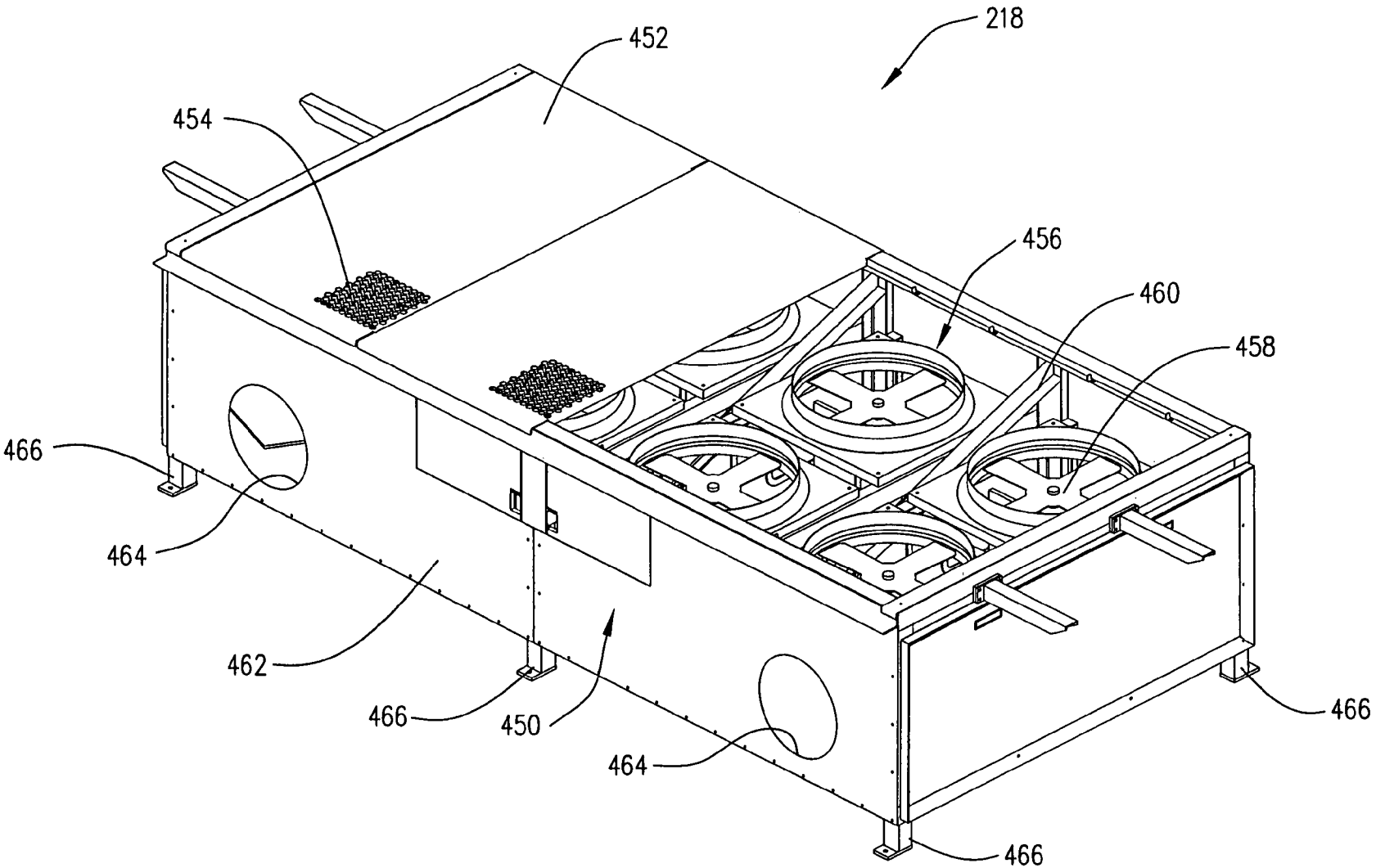
FIG. 27 shows a perspective of a cooling section.
Figure 23:
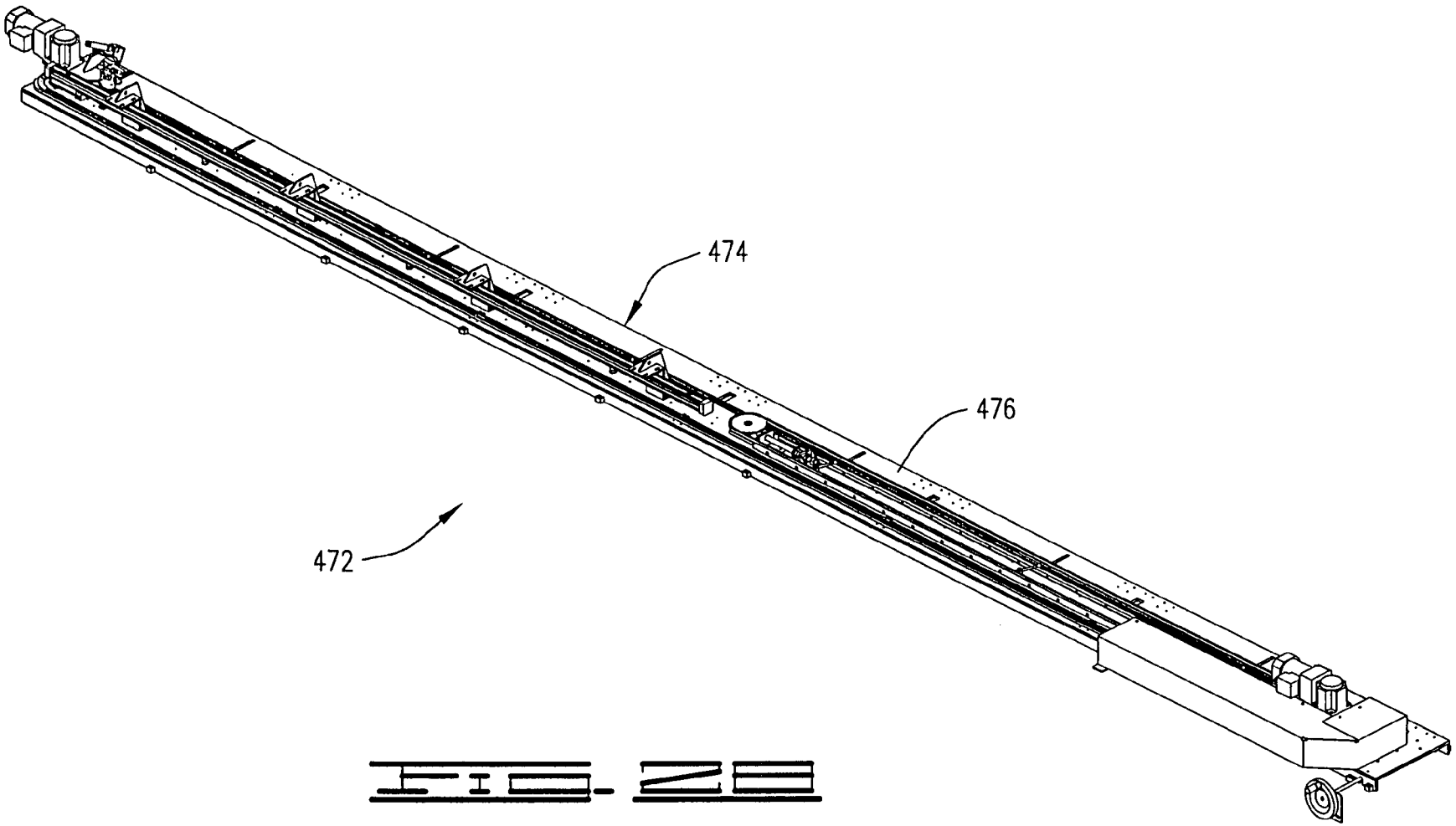
Figure 25A:
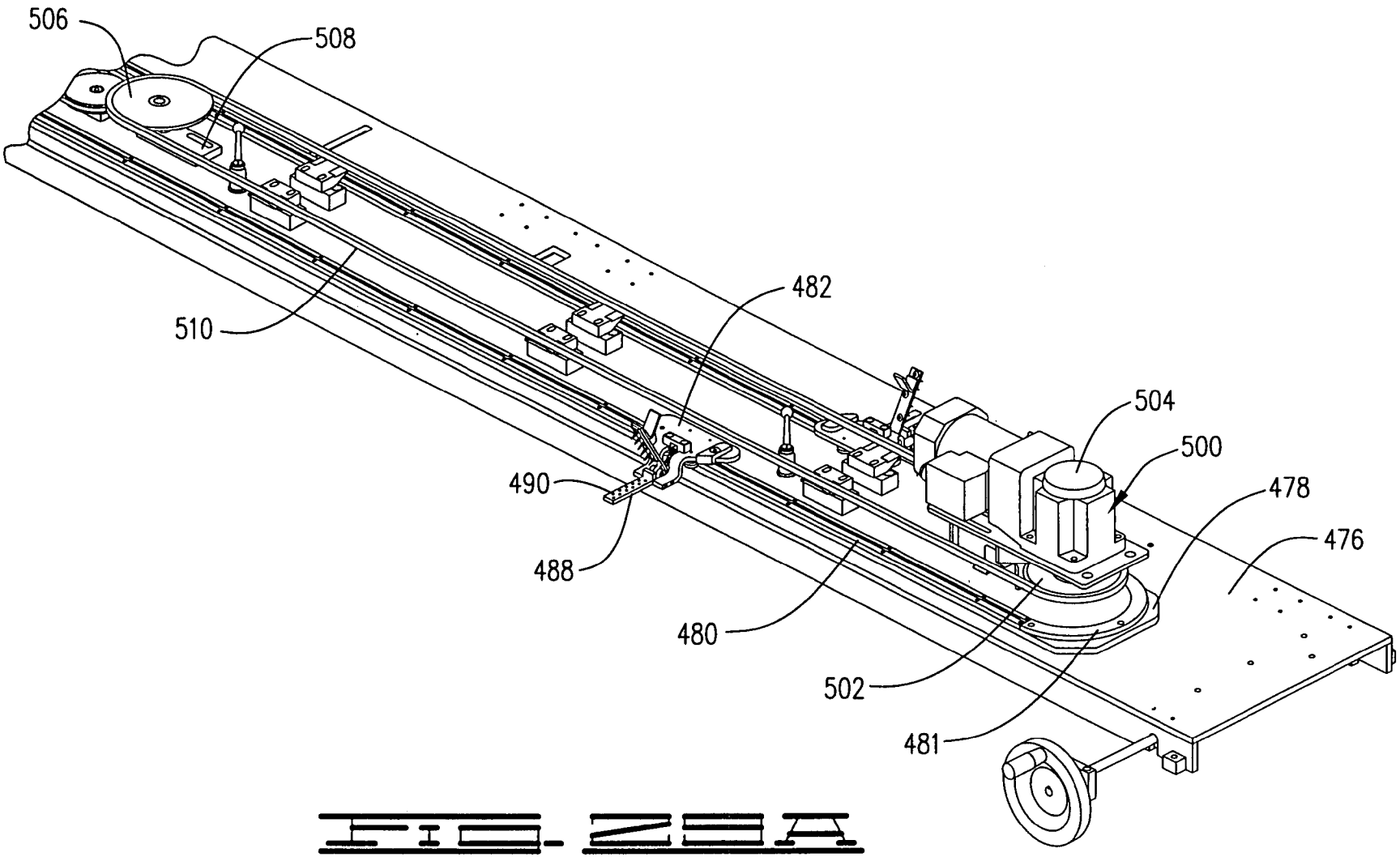
Figure 22:
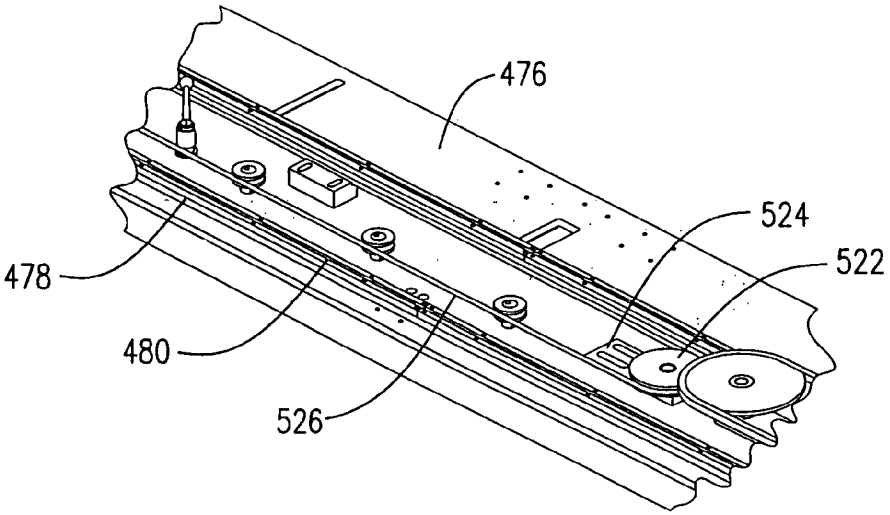
FIG. 22 is a perspective view of a working clamp assembly.
Figure 23:
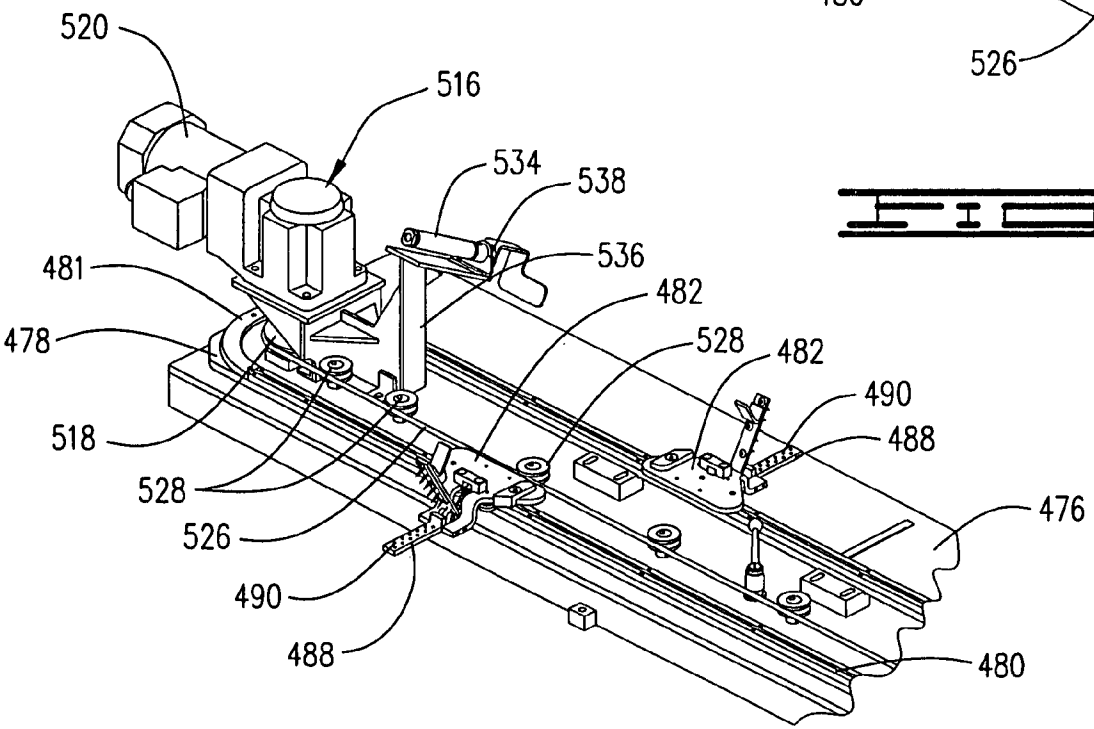

Referring again to FIGS. 18-20 and also to FIG. 27, cooling section 218 of second embodiment apparatus 210 includes a cooling system 450 with an upwardly facing cooling surface or table 452 thereon. Cooling surface 452 is substantially flat with a plurality of holes 454 or openings defined therein.

Cooling system 450 also has an air movement system 456. Air movement system 456 is characterized in the illustrated embodiment as a plurality of axial-flow propeller-type fans 458 mounted in a cooling frame 460. While propeller-type fans are illustrated, it will be understood by those skilled in the art that other types of fans could be substituted including, but not limited to, turbine, squirrel-cage or any other axial-flow or centrifugal flow fans or blowers. Virtually any device for moving air could be installed in air movement system 456. The invention is not intended to be limited solely to the fans shown in FIG. 27.

On one or more of the sides of cooling system 450 is a panel 462 with at least one duct opening 464 defined therethrough. Duct openings 464 provide an air inlet into cooling system 450.

Fans 456 are rotated by a drive means of a kind known in the art, such as one or more electric motors (not shown) so that the fans pull air into cooling system 218 through duct openings 464 and blow it upwardly and out of the cooling system through holes 454 in cooling table 452. It will be seen that this upward air flow through holes 454 will engage heated length 244 of carpet 242 above cooling table 452 and will thus act to cool the carpet and the backing thereon.

Cooling system 218 is supported on a plurality of feet 466.

Referring now to FIGS. 18-20, 28 and 29A-29C, a tenter system 472 is shown positioned alongside a portion of exit section 220 of second embodiment apparatus 210. Tenter system 472 comprises a pair of tenter assemblies 474 that extend longitudinally and are attached to frame 221 on opposite sides thereof. One such tenter assembly 474 is shown in detail in FIGS. 28 and 29A-29C.

Each tenter assembly 474 has a stationary plate 476 with a sliding plate 478 moveably disposed thereabove. An elongated, track 480 is disposed on sliding plate 478. Track 480 has curved ends 481 so that the track is effectively endless.

A plurality of carriage assemblies 482 are movable along track 480. See also FIG. 30. Spaced pairs of horizontally oriented wheels 484 are mounted on carriage assemblies 482 and engage track 480 so that the carriage assemblies may be moved along and around the track while vertical movement of the carriage assemblies is substantially prevented.

Each carriage assembly 482 has a bar 488 extending outwardly and substantially horizontally therefrom. Each bar 488 defines a plurality of holes 490 therein so that it may be said that each bar 488 is perforated.

Each carriage assembly 482 also has an arm 492 with a plurality of teeth 494 thereon. Each arm 494 has an upward first position as seen in FIG. 30 and a downward second position in which the arm abuts a corresponding bar 488 wherein teeth 494 extend into corresponding holes 490. Arms 494 are biased toward the upward first position by springs 496 mounted on each carriage assembly 482. Each arm 492 has a prong 498 extending at an angle from the upper surface of the arm.

A chain drive system 500 is mounted to the forward end of each tenter assembly 474. Chain drive system 500 includes a drive sprocket 502 that is mounted on sliding plate 478 and is driven by a servo motor 504. Spaced longitudinally from drive sprocket 502 is a tension sprocket 506. Tension sprocket 506 is attached to sliding plate 478 by a slidable tension plate 508. A chain 510 is engaged with drive sprocket 502 and tension sprocket 510. It will be seen that the desired tension in chain 510 can be set by sliding tension plate 508 and locking the tension plate against sliding plate 478. It will thus also be seen that actuating servo motor 504 to rotate drive socket 502 will also result in rotation of tension sprocket 506 with corresponding movement of chain 510. Chain 510 is supported at various places by a plurality of chain supports 512.

Adjacent to chain drive system 500 is a belt drive system 516. Belt drive system 516 includes a drive pulley 518 that is mounted on sliding plate 478 and is driven by a servo motor 520. Spaced longitudinally from drive pulley 518 is a tension pulley 522. Tension pulley 522 is attached to sliding plate 478 by a slidable tension plate 524. A belt 526 is engaged with drive pulley 518 and tension pulley 522. It will be seen that the desired tension in belt 526 can be set by sliding tension plate 524 and locking the tension plate against sliding plate 478. It will also be seen that actuating servo motor 520 to rotate drive pulley 518 will also result in rotation of tension pulley 522 with corresponding movement of belt 526. Belt 526 is guided and supported at various places by a plurality of idler pulleys 528.

Adjacent to servo motor 520 on belt drive system 516 is a pneumatic or hydraulic cylinder 534 that is attached to an upright support 536 by a bracket 538. Cylinder 534 is disposed at an angle so that it actuates downwardly and inwardly toward the center of apparatus 210. A member 540 is connected to the actuating or piston end of cylinder 534.

Tenter system 472 is designed to grip the longitudinal sides of length 244 of carpet 242 along tenters 245 (see again FIG. 19) thereon and guide it as it moves along cooling section 218. As will be further described herein, tenter system 472 also acts to prevent transversely inward stretching of the carpet as it is being straightened in apparatus 210. It keeps carpet 242 substantially flat as it moves through apparatus 210.

Figure 31:
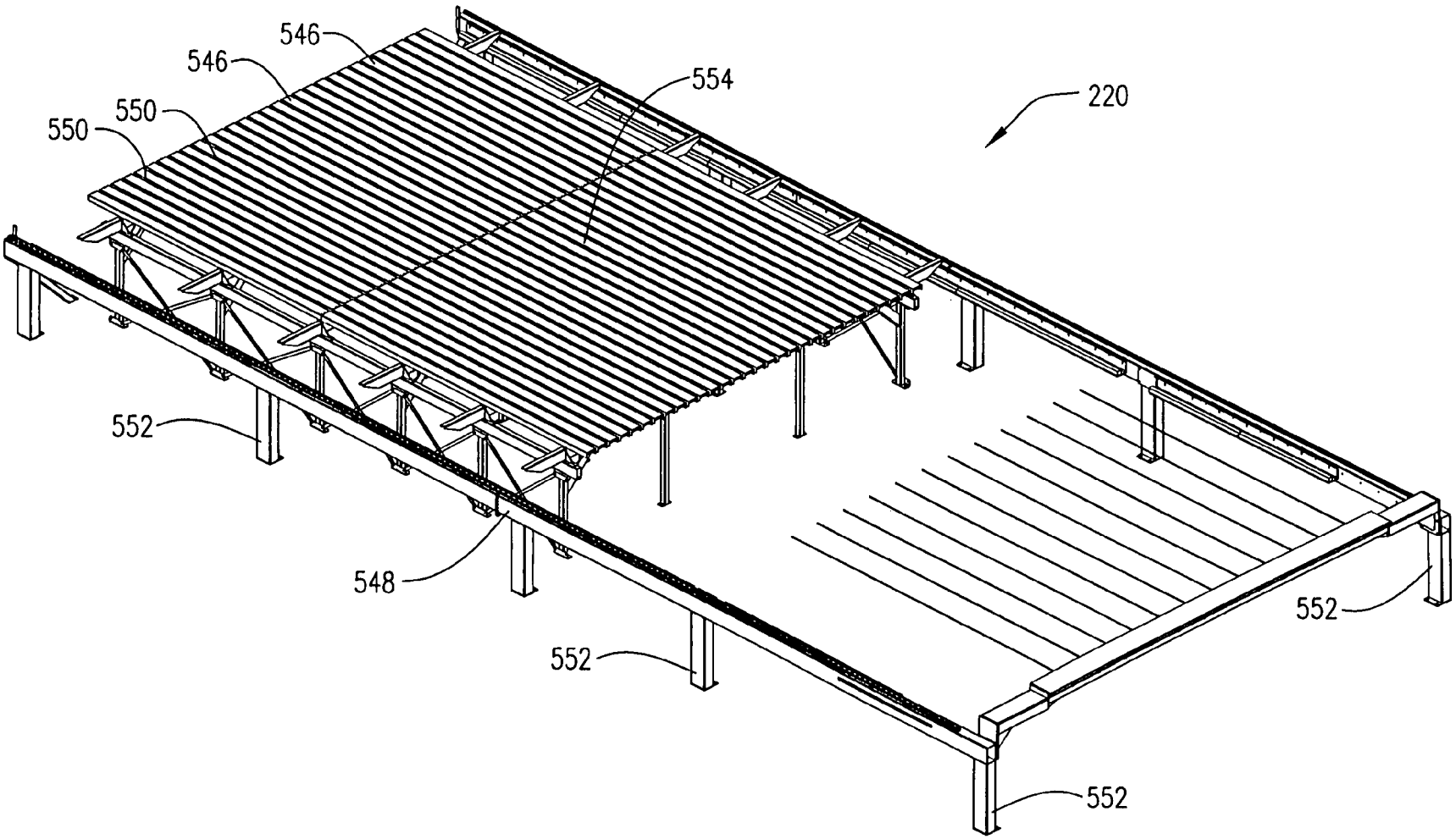
FIG. 31 illustrates a perspective of an exit section of the second embodiment.

Referring again to FIGS. 18-20 and also to FIG. 31, the details of exit section 220 of apparatus 210 are shown. Exit section 220 comprises a plurality of parallel rails 546. Rails 546 extend longitudinally on a frame 548 and are transversely spaced from one another so that a small gap 550 is defined therebetween. Frame 548 has a plurality of legs 552 so that an upper surface 554 of rails 546 is held substantially horizontal and aligned with cooling table 452.

Operation of the Second Embodiment

As previously mentioned, to use second embodiment apparatus 210, a roll 240 of carpet 242 may be positioned on rack 232 of queue station 212. Actuating cylinders 234 are then retracted so that roll 240 rolls onto entry conveyor 238 of unwind section 214. A portion of carpet 242 may then be unrolled so that extended length 244 of the carpet may be laid onto nip roller 248 to engage teeth 250 thereof. Drive system 252 is engaged to unroll carpet 242 and move length 244 thereof into heating and straightening section 260. A sufficient length 244 of carpet 242 is thus unrolled so that the carpet extends into and through primary clamp assembly 406.

As length 244 of carpet 242 is moved on the apparatus, tenter system 472 is engaged with the carpet adjacent to border 245 thereof. Cylinder 534 is actuated so that bracket 538 engages prong 498 so that arm 492 is moved to its lower position in which teeth 494 penetrate the carpet and fit into holes 490 in bar 488. Arms 492 are thus engaged at spaced intervals along length 244 of carpet 242. Carriage assemblies 482 are free to roll along track 480 as carpet 242 moves. Tenter system 472 thus acts to keep length 244 of carpet 242 taut so that it cannot stretch in a transverse direction (inwardly).

Carriage assemblies 482 are so engaged with length 244 of carpet 242 and roll along track 480 from an area adjacent to working head assembly 310 to an area past pulling clamp assembly adjacent to exit section 220.

Length 244 is moved so that it is supported on wires 261 above heating system 262. Heat from oven 264 heats length 244 of carpet 242 as previously mentioned. The heat generated by oven 264 is controlled with electrical controls within control panel 223 sufficiently to soften the backing on the carpet without melting it. The temperature necessary to soften backing of different carpets can vary with the actual material of the backing. Thus, it is desirable to control the amount of heat applied thereto, and control panel 223 allows such control.

After the carpet is heated sufficiently, a straightening operation may be carried out using the straightening components of heating and straightening section 216. Laser 224 is used to project laser image line 229 onto length 244 of carpet 242. Line 229 is projected to be substantially perpendicular to the longitudinal edges of the carpet. Preferably, using video camera 231 looking down on carpet 242, the operator of apparatus 210 can observe line 229 with relationship to any pattern in the carpet and thus determine whether, and how much, straightening of the heated carpet is required. Alternatively or more or less simultaneously, the operator can also directly visually observe line 229 on the carpet.

Working head assembly 310 is longitudinally positioned generally adjacent to unwind section 214, and locking handle 317 is used to lock the working head assembly in place.

When it is determined that a portion of the carpet needs correction, gripper cylinders 416 in primary clamp assembly 406 are actuated using control panel 223 so that gripper 418 is moved downwardly into engagement with flat length 244 of carpet 242 so that it is clamped against working surface or table 336. Once carpet 242 is thus held firmly in place by gripper 418, using control panel 223 the operator may bring working plates 340 close to length 244 of carpet 232 by actuating shaft actuation cylinders 328. Then, working plates 340 may be individually and selectively engaged with the heated carpet by actuating working cylinders 332. Because of the angled orientation, working plates 340 pull or stretch the carpet in a longitudinal direction away from primary clamp assembly 406. The longitudinal pulling forces applied to length 244 of carpet 242 are substantially the same as previously described for first embodiment apparatus 10. Again, it is important to understand that the actuation of working cylinders 332 is individually controlled so that any working cylinder or any combination of working cylinders can be actuated. Thus, only that portion of the carpet that needs to be stretched to straighten the pattern therein is actually engaged and stretched. It will be seen that great versatility is provided to the operator to clamp and stretch the desired portion of the carpet to straighten it in the manner necessary.

Holding clamp assembly 364, controlled by control panel 223, is positioned longitudinally so that it is adjacent to working head assembly 310. It will be seen that this positions holding plates 388 on holding clamp assembly 364 as close to working plates 340 as possible. Also using control panel 223, pulling clamp assembly 426 is positioned longitudinally so that it is adjacent to primary clamp assembly 426.

After the straightening operation is carried out, using control panel 223, holding cylinders 384 on holding clamp assembly 364 are actuated to move holding plates 388 into engagement with length 244 of carpet 242 so that the carpet is clamped against holding surface 394. At about the same time, pulling cylinders 432 on pulling clamp assembly 426 are actuated by control panel 223 so that it engages the surface of length 244 of carpet 242 therebelow, thus clamping the carpet against the upper portion of exit section 220. Actuators 449 on corrective reference assembly 446 are actuated to lower string 448 as previously described. In this way, it can be visually insured that the carpet is positioned properly in exit section 220 so that it can be moved straightly when pulling clamp assembly 426 is moved away from primarily clamp assembly 406 as more fully described below.

Shaft actuation cylinders 326 in working head assembly 310 and/or working cylinders 332 are retracted to disengage working plates 340 from carpet 242, and gripper cylinders 416 in primary clamp assembly 406 to raise gripper 418 away from the carpet.

Servo motors 440 are then operated through control panel 223 so that pulling clamp assembly 426 is moved away from primary clamp assembly 406 to move the carpet longitudinally along apparatus 210. The carpet will slide along exit section 220 even though clamped thereto by pulling clamp 434. Because the carpet is also clamped in holding clamp 364, it will be seen that the holding clamp assembly will move along frame 221 as pulling clamp assembly 426 is moved by servo motors 440.

The straightened portion of length 244 of carpet 242 is thus moved over cooling section 218 where the air flow therefrom cools the heated carpet so that the backing thereof is again hardened to its original consistency. When this occurs, the carpet will remain in its straightened condition even when unclamped from working head assembly 364 and primary clamp assembly 406.

As length 244 of carpet 242 is moved away from cooling section 218, arms 492 of carriage assemblies of tenter system 472 are disengaged from the carpet after the backing thereof is cooled.

At this point, working head assembly 310 is again engaged with the carpet adjacent thereto, and primary clamp assembly 406 is reengaged with the portion of the adjacent carpet.

Servo motors 520 of belt drive systems 516 are actuated to drive chain 510 so that carriage assemblies 482 are moved around track 480 to return the carriage assemblies to their original position so that they can reengage carpet 242.

It will thus be seen that the cycle can be repeated as necessary to straighten the complete roll of carpet 242 a portion at a time. When pulling clamp assembly 426 is moved back toward primary clamp 406, actuators 449 are actuated to raise corrective reference assembly 446 to its raised position.

It will be seen that at all times during the straightening and moving portions of the cycle, carpet 242 is clampingly engaged in two locations so that the straightening/stretching forces continue to hold the carpet in the straightened position until the carpet can be cooled and subsequently released.

At the end of the complete straightening operation, the roll of carpet 242 may then be removed from exit section 220 of second embodiment 210 and transported to the installation location. As with first embodiment 10, because the pattern has been straightened, manual straightening on the floor by the installer is greatly reduced or eliminated. This significantly lowers operating costs and fatigue for the installer. It also allows much more carpet to be installed in the same amount of time compared to prior manual techniques.

It will be seen, therefore, that the carpet straightening apparatus of the present invention is well adapted to carry out the ends and advantages mentioned as well as those inherent therein. While some presently preferred embodiments are shown for the purposes of this disclosure, numerous changes in the arrangement and construction of parts may be made by those skilled in the art. All such changes are encompassed within the scope and spirit of the appended claims.

What is claimed is:

1. An apparatus for straightening carpet comprising:

a heating section for heating at least a portion of a roll of carpet such that a backing material on the carpet is softened; and a straightening section adapted for applying substantially longitudinal stretching forces to the heated carpet, whereby the carpet is straightened while the backing is softened and is held in substantially a substantially straight position when the backing is subsequently cooled.

2. The apparatus of claim 1 further comprising an entry section adapted for receiving the roll of carpet and comprising a powered roller for turning the roll of carpet such that a portion thereof is unrolled and moved toward the straightening section.

3. The apparatus of claim 1 further comprising a tenter system for engaging the carpet adjacent to a border thereof and substantially preventing transverse stretching of the carpet as the longitudinal stretching forces are applied thereto.

4. The apparatus of claim 3 wherein the tenter system comprises:

a bar defining a plurality of holes therein;

an arm pivotally disposed adjacent to the bar and having a plurality of teeth thereon, the aim having a first position pivoted away from the bar and a second position adjacent to the bar so that the teeth on the aim extend through corresponding holes in the bar wherein the carpet is held between the arm and bar.

5. The apparatus of claim 4 further comprising a moveable bracket adapted for moving the arm from the first position to the second position thereof.

6. The apparatus of claim 5 wherein the bracket is moved by actuation of a cylinder.

7. The apparatus of claim 3 wherein the bar and arm are mounted to a carriage assembly that is longitudinally moveable.

8. The apparatus of claim 1 wherein the heating section comprises an infrared oven.

9. The apparatus of claim 1 further comprising a cooling section whereby the carpet can be cooled after straightening thereof.

10. The apparatus of claim 9 further comprising a blower for moving air across the carpet.

11. The apparatus of claim 10 wherein the blower is an axial-flow blower.

12. The apparatus of claim 9 wherein the cooling section comprises a plurality of wires for supporting the carpet such that air can contact the lower surface thereof

13. The apparatus of claim 9 further comprising a pulling clamp assembly for engaging the carpet and moving it from the heating section to the cooling section.

14. The apparatus of claim 13 further comprising a holding clamp assembly spaced from the pulling clamp assembly and adapted for engaging the carpet and holding it in the straightened position as it is moved by the pulling clamp assembly.

15. The apparatus of claim 13 further comprising a corrective reference assembly for indicating straightness of the carpet adjacent to the pulling clamp assembly.

16. The apparatus of claim 15 wherein the corrective reference assembly is attached to the pulling clamp assembly.

17. The apparatus of claim 15 wherein the corrective reference assembly comprises a string that can be positioned adjacent to a surface of the carpet.

18. The apparatus of claim 1 wherein the straightening section comprises a surface for substantially horizontally supporting the carpet while the carpet is straightened.

19. The apparatus of claim 1 wherein the straightening section comprises:

a plurality of working plates adapted for engagement with the carpet;

and a plurality of working cylinders corresponding to the working plates whereby the plates may be moved into and out of engagement with the carpet.

20. The apparatus of claim 19 wherein all of the working cylinders can be pivoted with respect to the carpet substantially simultaneously.

21. The apparatus of claim 20 wherein the working cylinders are pivoted by actuation of a cylinder.

22. The apparatus of claim 19 wherein the working cylinders are substantially parallel.

23. The apparatus of claim 19 wherein the working cylinders are selectively actuable individually and in combination.

24. The apparatus of claim 19 further comprising a primary clamp assembly spaced from the working plates and adapted for clamping the carpet whereby the carpet is held while the stretching forces are applied.

25. The apparatus of claim 24 wherein the primary clamp assembly comprises:

a gripper; and a gripper cylinder for moving the gripper into and out of engagement with the carpet.

26. The apparatus of claim 25 wherein the gripper cylinder is substantially vertical.

27. The apparatus of claim 1 further comprising a control system for controlling the heating and straightening sections.

28. The apparatus of claim 27 wherein the control system comprises a laser for projecting a line on the carpet for providing an alignment guide for straightening the carpet.

29. The apparatus of claim 27 wherein the control system further comprises:

a video camera; and a display of an image taken by the camera.

30. The apparatus of claim 1 further comprising a corrective reference for indicating a straightness of the carpet adjacent to the cooling section.

31. The apparatus of claim 30 wherein the corrective reference comprises a string positionable adjacent to the carpet.

32. The apparatus of claim 31 wherein the string extends substantially transversely to the carpet.

33. An apparatus for straightening carpet comprising:

an entry section adapted for receiving a roll of carpet thereon;

a heating section which receives a portion of the carpet from said entry section for heating said portion of the carpet such that a backing material on the carpet is softened;

a straightening section which receives the carpet from said heating section and is adapted for applying stretching forces thereto, whereby the carpet is straightened after the backing has been at least partially softened;

a cooling section which receives the carpet from said straightening section whereon the carpet is cooled;

an exit section for receiving the cooled carpet; and a control system for controlling the heating, straightening and cooling sections.

34. The apparatus of claim 33 wherein the entry section comprises a powered roller for turning the roll of carpet such that a portion thereof is unrolled and moved toward the straightening section.

35. The apparatus of claim 1 further comprising a tenter system for engaging a border portion of the carpet and substantially preventing stretching of the carpet in a transverse direction as the stretching forces are applied longitudinally thereto.

36. The apparatus of claim 35 wherein the tenter system comprises:

a bar;

an arm pivotally disposed adjacent to the bar and having a plurality of teeth thereon, the arm having a first position pivoted away from the bar and a second position adjacent to the bar so that the teeth on the arm engage the carpet so that the carpet is held between the arm and bar.

37. The apparatus of claim 36 further comprising a moveable bracket adapted for moving the arm from the first position to the second position thereof.

38. The apparatus of claim 37 wherein the bracket is moved by actuation of a cylinder.

39. The apparatus of claim 36 wherein the bar and arm are mounted to a carriage assembly that is longitudinally moveable.

40. The apparatus of claim 1 wherein the heating section comprises an infrared oven.

41. The apparatus of claim 1 wherein the cooling section comprises a blower for moving air across the carpet.

42. The apparatus of claim 41 wherein the blower is an axial-flow blower.

43. The apparatus of claim 1 wherein the cooling section comprises a plurality of wires for supporting the carpet such that air can contact the lower surface thereof

44. The apparatus of claim 33 further comprising a pulling clamp assembly for engaging the carpet and moving it from the heating section to the cooling section.

45. The apparatus of claim 44 further comprising a holding clamp assembly spaced from the pulling clamp assembly and adapted for engaging the carpet and holding it in the straightened position as it is moved by the pulling clamp assembly.

46. The apparatus of claim 44 further comprising a corrective reference assembly for indicating straightness of the carpet adjacent to the pulling clamp assembly.

47. The apparatus of claim 46 wherein the corrective reference assembly is attached to the pulling clamp assembly.

48. The apparatus of claim 46 wherein the corrective reference assembly comprises a string that can be positioned adjacent to a surface of the carpet.

49. The apparatus of claim 33 wherein the straightening section comprises a surface for substantially horizontally supporting the carpet while the carpet is straightened.

50. The apparatus of claim 33 wherein the straightening section comprises:

a plurality of working plates adapted for engagement with the carpet; and a plurality of working cylinders corresponding to the working plates adapted for moving the plates into and out of engagement with the carpet.

51. The apparatus of claim 50 wherein all of the working cylinders can be pivoted substantially simultaneously.

52. The apparatus of claim 51 wherein the working cylinders are pivoted by actuation of a cylinder.

53. The apparatus of claim 50 wherein the working cylinders are substantially parallel.

54. The apparatus of claim 50 wherein the working cylinders are selectively actuable individually and in combination.

55. The apparatus of claim 50 further comprising a primary clamp assembly spaced from the working plates and adapted for clamping the carpet such that the carpet is held while the stretching forces are applied.

56. The apparatus of claim 55 wherein the primary clamp assembly comprises:

a gripper; and a gripper cylinder for moving the gripper into and out of engagement with the carpet.

57. The apparatus of claim 56 wherein the gripper cylinder is positioned substantially vertical.

58. The apparatus of claim 33 wherein the control system comprises a laser for projecting a line on the carpet for providing an alignment guide for straightening the carpet.

59. The apparatus of claim 33 wherein the control system further comprises:

a video camera; and a display of an image taken by the camera.

60. The apparatus of claim 33 further comprising a corrective reference for indicating a straightness of the carpet adjacent to the cooling section.

61. The apparatus of claim 60 wherein the corrective reference comprises a string positionable adjacent to the carpet.

62. The apparatus of claim 61 wherein the string extends substantially transversely to the carpet.

* * * * *